US010030899B2

(12) United States Patent
Jindou et al.

(10) Patent No.: US 10,030,899 B2
(45) Date of Patent: Jul. 24, 2018

(54) REFRIGERANT EVAPORATOR

(71) Applicant: DAIKIN INDUSTRIES, LTD., Osaka-shi, Osaka (JP)

(72) Inventors: Masanori Jindou, Settsu (JP); Yoshio Oritani, Settsu (JP); Tomohiko Sakamaki, Sakai (JP); Junichi Hamadate, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/518,487

(22) PCT Filed: Oct. 9, 2015

(86) PCT No.: PCT/JP2015/078734
§ 371 (c)(1),
(2) Date: Apr. 12, 2017

(87) PCT Pub. No.: WO2016/060078
PCT Pub. Date: Apr. 21, 2016

(65) Prior Publication Data

US 2017/0234587 A1 Aug. 17, 2017

(30) Foreign Application Priority Data

Oct. 16, 2014 (JP) ..... 2014-211978

(51) Int. Cl.
*F25B 39/00* (2006.01)
*F28F 9/02* (2006.01)
*F25B 39/02* (2006.01)

(52) U.S. Cl.
CPC ..... *F25B 39/00* (2013.01); *F28F 9/0204* (2013.01); *F28F 9/028* (2013.01); *F28F 9/0243* (2013.01); *F28F 9/0273* (2013.01); *F25B 39/028* (2013.01)

(58) Field of Classification Search
CPC ..... F25B 39/00; F25B 39/028; F25B 39/02; F25B 13/00; F28F 9/0204; F28F 9/028;
(Continued)

(56) References Cited

U.S. PATENT DOCUMENTS 6,397,627 B1 * 6/2002 Aki ..... F25B 39/04 62/509
2006/0124288 A1 * 6/2006 Demuth ..... B60H 1/00335 165/175

(Continued)

FOREIGN PATENT DOCUMENTS

JP 2011-231972 A 11/2011

OTHER PUBLICATIONS

International Search Report of corresponding PCT Application No. PCT/JP2015/078734 dated Dec. 15, 2015.

(Continued)

*Primary Examiner* — Mohammad M Ali
(74) *Attorney, Agent, or Firm* — Global IP Counselors, LLP

(57) ABSTRACT

A refrigerant evaporator includes a plurality of vertically disposed flat tubes, and a refrigerant distribution and supply section that causes inflowing refrigerant to flow out to the plurality of flat tubes on a downstream side. The refrigerant distribution and supply section includes a refrigerant supply section having plural supply spaces, a refrigerant introduction and distribution section having an introduction space to introduce the inflowing refrigerant from a lower end side surface, and a distribution space to distribute the refrigerant, and plural connecting passages that guide the refrigerant to the supply spaces. A first flat tube communicating with a lowermost-tier supply space positioned on the lowermost side is disposed at a height position included in a height range of the introduction space, and a lowermost-tier connecting passage that guides the refrigerant to the lowermost-tier supply space is disposed at a position higher than the introduction space.

14 Claims, 26 Drawing Sheets

(58) Field of Classification Search
CPC ..... F28F 9/0273; F28F 9/0243; F28F 9/0212; F28F 9/0246; F28F 9/18; F28F 9/0214; F28F 9/0253; F28F 9/0202; F28F 9/027; F28F 1/325; F28F 9/02; F28D 2021/0085; F28D 1/053
USPC ..... 62/527
See application file for complete search history.

(56) References Cited

U.S. PATENT DOCUMENTS

2006/0179876 A1* 8/2006 Yagisawa ..... F25B 39/02 62/515
2008/0251245 A1* 10/2008 Gorbounov ..... F25B 39/028 165/178
2013/0240187 A1* 9/2013 Hamaguchi ..... F24F 1/18 165/150
2013/0292104 A1* 11/2013 Park ..... F28F 9/02 165/173
2013/0299141 A1* 11/2013 Jindou ..... F28D 1/05383 165/151
2014/0174703 A1* 6/2014 Yoshioka ..... F28D 7/0033 165/173
2014/0284035 A1* 9/2014 Park ..... F28F 9/0273 165/173

OTHER PUBLICATIONS

International Preliminary Report of corresponding PCT Application No. PCT/JP2015/078734 dated Apr. 27, 2017.
European Search Report of corresponding EP Application No. 15 84 9942.6 dated May 24, 2018.

* cited by examiner

REFRIGERANT EVAPORATOR

CROSS-REFERENCE TO RELATED APPLICATIONS

This U.S. National stage application claims priority under 35 U.S.C. § 119(a) to Japanese Patent Application No. 2014-211978, filed in Japan on Oct. 16, 2014, the entire contents of which are hereby incorporated herein by reference.

TECHNICAL FIELD

The present invention relates to a refrigerant evaporator, and particularly a refrigerant evaporator equipped with plural flat tubes disposed along the vertical direction and a refrigerant distributor that causes inflowing refrigerant to flow out to the plural flat tubes on the downstream side.

BACKGROUND ART

Conventionally, as described in JP A No. 2011-231972, there have been plural refrigerant outflow tubes (flat tubes) disposed along the vertical direction and a refrigerant distributor (a refrigerant distribution and supply section) that causes inflowing refrigerant to flow out to the plural refrigerant outflow tubes (flat tubes) on the downstream side. In this refrigerant distributor, the inflowing refrigerant is introduced from a lower end lower surface and caused to flow out to the plural refrigerant outflow tubes on the downstream side.

SUMMARY

In the above conventional refrigerant distributor, a structure that introduces the refrigerant from the lower end lower surface is employed from the standpoint of ensuring the ability to distribute the refrigerant, but a refrigerant evaporator including the refrigerant distributor must be disposed in a high position in correspondence to introducing the refrigerant from the lower end lower surface, and because of this, the refrigerant evaporator is not suited to installation on a bottom plate of a casing of an outdoor unit or the like of an air conditioning apparatus.

It is an object of the present invention to make a refrigerant evaporator, equipped with plural flat tubes disposed along the vertical direction and a refrigerant distribution and supply section that causes inflowing refrigerant to flow out to the plural flat tubes on the downstream side, into one suited for installation on a bottom plate of a casing of an outdoor unit or the like of an air conditioning apparatus, while ensuring its ability to distribute the refrigerant.

A refrigerant evaporator pertaining to a first aspect includes a plurality of flat tubes disposed along the vertical direction and a refrigerant distribution and supply section that causes inflowing refrigerant to flow out to the plurality of flat tubes on the downstream side. Here, the refrigerant distribution and supply section includes a refrigerant supply section, a refrigerant introduction and distribution section, and a plurality of connecting passages. The refrigerant supply section is a part extending in the vertical direction and in which are formed a plurality of supply spaces that divide the plurality of flat tubes into a plurality of refrigerant paths including a predetermined number of the flat tubes along the vertical direction and cause the refrigerant to flow out. The refrigerant introduction and distribution section is a part extending in the vertical direction and having a refrigerant introduction section, in which is formed an introduction space for introducing the inflowing refrigerant from a lower end side surface, and a refrigerant distribution section, in which is formed a distribution space for distributing the refrigerant. The plurality of connecting passages are parts that guide the refrigerant from the refrigerant distribution section to the plurality of supply spaces in the refrigerant supply section. Additionally, given that the supply space positioned on the lowermost side out of the plurality of supply spaces is a lowermost-tier supply space, and that the connecting passage that guides the refrigerant to the lowermost-tier supply space out of the plurality of connecting passages is a lowermost-tier connecting passage, and that the flat tube positioned on the lowermost side out of the flat tubes communicating with the lowermost-tier supply space is a first flat tube, the first flat tube is disposed in a height position included in a height range of the introduction space, and the lowermost-tier connecting passage is disposed in a position higher than the introduction space.

Here, after the refrigerant in a gas-liquid mixed state flowing from the lower end side surface into the refrigerant introduction and distribution section has been distributed equally by the refrigerant introduction and distribution section, the refrigerant can be guided through the lowermost-tier connecting passage to the lowermost-tier supply space in the refrigerant supply section. Because of this, here, the refrigerant evaporator can be made into one suited for installation on a bottom plate of a casing of an outdoor unit or the like of an air conditioning apparatus, while ensuring its ability to distribute the refrigerant to the plural flat tubes including the first flat tube in the lowermost-tier supply space.

A refrigerant evaporator pertaining to a second aspect is the refrigerant evaporator pertaining to the first aspect, wherein the introduction space and the distribution space are partitioned from each other by a nozzle member in which a nozzle hole is formed.

Here, the height dimensions of the introduction space and the distribution space can be reduced, and the height position of the lowermost-tier connecting passage can also be lowered.

A refrigerant evaporator pertaining to a third aspect is the refrigerant evaporator pertaining to the second aspect, wherein a nozzle recess portion that is a recessed part larger in diameter than the nozzle hole is formed in an upper surface of the nozzle member, and the distribution space is configured by a space formed by the nozzle recess portion.

Here, the height dimension of the distribution space can be reduced because of the nozzle recess portion formed in the nozzle member, and the height position of the lowermost-tier connecting passage can also be lowered.

A refrigerant evaporator pertaining to a fourth aspect is the refrigerant evaporator pertaining to any of the first to third aspects, wherein given that the flat tube positioned on the uppermost side out of the predetermined number of the flat tubes communicating with the lowermost-tier supply space is a second flat tube, the lowermost-tier connecting passage is disposed in a height position even with or higher than the second flat tube.

Here, the refrigerant can be kept from becoming easier to be introduced to the second flat tube out of the flat tubes communicating with the lowermost-tier supply space in the refrigerant supply section, and the refrigerant in the gas-liquid mixed state flowing to the flat tubes communicating with the lowermost-tier supply space can be equalized.

A refrigerant evaporator pertaining to a fifth aspect is the refrigerant evaporator pertaining to any of the first to fourth aspects, wherein the refrigerant supply section, the refrigerant introduction and distribution section, and the connecting passages are formed in a single header-distributor dual purpose case extending in the vertical direction.

A refrigerant evaporator pertaining to a sixth aspect is the refrigerant evaporator pertaining to any of the first to fourth aspects, wherein the refrigerant supply section is formed in a header case extending in the vertical direction, and the refrigerant introduction and distribution section is formed in a distributor case extending in the vertical direction. Additionally, the header case and the distributor case are connected to each other via a plurality of connecting pipes forming the plurality of connecting passages.

DESCRIPTION OF EMBODIMENT

An embodiment of a refrigerant evaporator pertaining to the present invention and example modifications thereof will be described below on the basis of the drawings. It should be noted that the specific configurations of the refrigerant evaporator pertaining to the present invention are not limited to those in the following embodiment and the example modifications thereof, and can be changed to the extent that they do not depart from the spirit of the invention.

(1) Overall Configuration of Air Conditioning Apparatus

Figure 1:
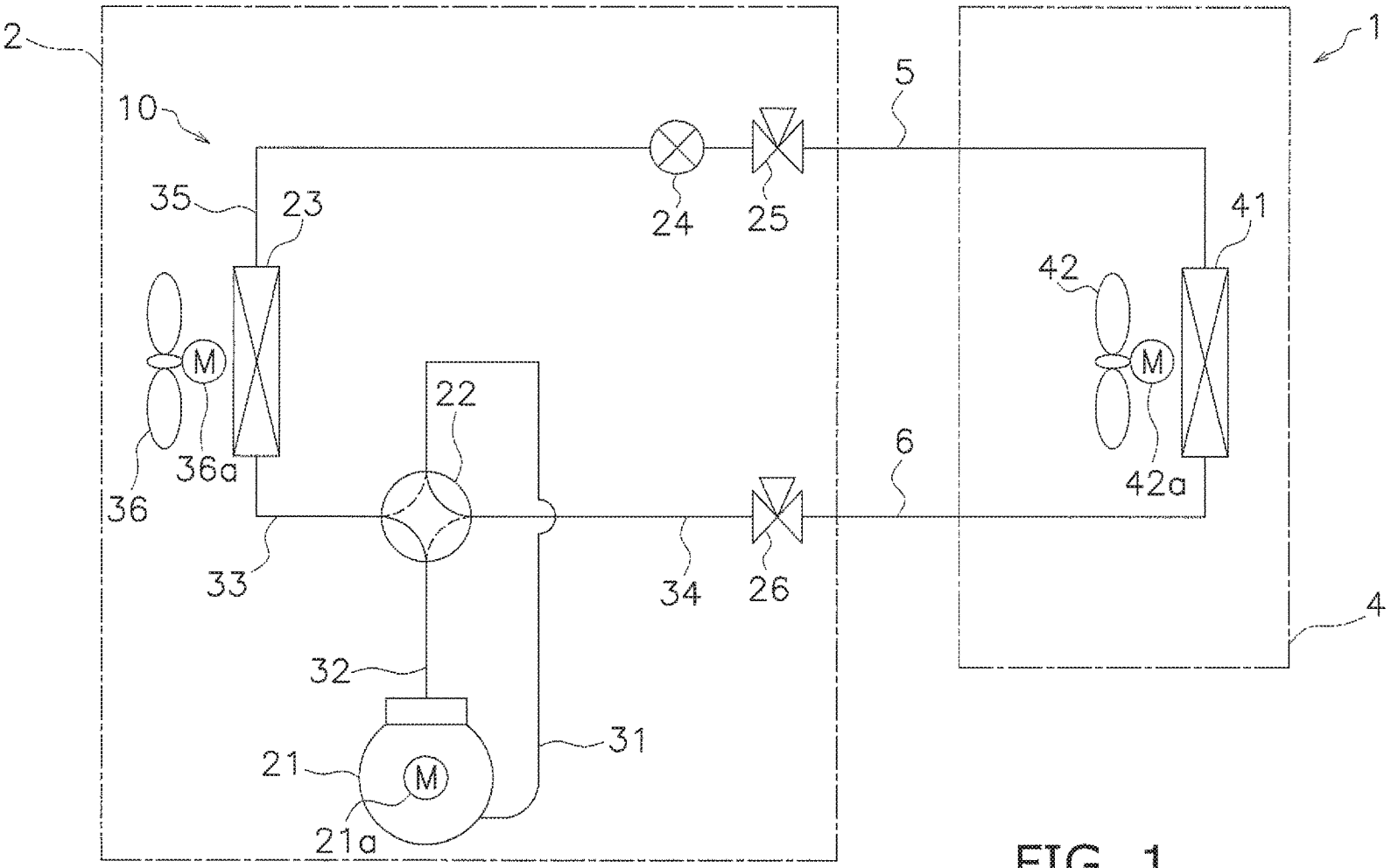
FIG. 1 is a general configuration diagram of an air conditioning apparatus having an outdoor heat exchanger serving as a refrigerant evaporator pertaining to an embodiment of the present invention.

FIG. 1 is a general configuration diagram of an air conditioning apparatus 1 having an outdoor heat exchanger 23 serving as the refrigerant evaporator pertaining to the embodiment of the present invention.

The air conditioning apparatus 1 is an apparatus capable of cooling and heating a room in a building or the like by performing a vapor compression refrigeration cycle. The air conditioning apparatus 1 is configured as a result of mainly an outdoor unit 2 and an indoor unit 4 being connected to each other. Here, the outdoor unit 2 and the indoor unit 4 are connected to each other via a liquid refrigerant connection pipe 5 and a gas refrigerant connection pipe 6. That is, a vapor compression refrigerant circuit 10 of the air conditioning apparatus 1 is configured as a result of the outdoor unit 2 and the indoor unit 4 being connected to each other via the refrigerant connection pipes 5 and 6.

<Indoor Unit>

The indoor unit 4 is installed in a room and configures part of the refrigerant circuit 10. The indoor unit 4 mainly has an indoor heat exchanger 41.

The indoor heat exchanger 41 is a heat exchanger which, during the cooling operation, functions as a refrigerant evaporator to cool the room air and which, during the heating operation, functions as a refrigerant radiator to heat the room air. The liquid side of the indoor heat exchanger 41 is connected to the liquid refrigerant connection pipe 5, and the gas side of the indoor heat exchanger 41 is connected to the gas refrigerant connection pipe 6.

The indoor unit 4 has an indoor fan 42 for sucking room air into the indoor unit 4, allowing the room air to exchange heat with refrigerant in the indoor heat exchanger 41, and thereafter supplying the air as supply air to the room. That is, the indoor unit 4 has the indoor fan 42 as a fan that supplies to the indoor heat exchanger 41 the room air serving as a heating source or a cooling source for the refrigerant flowing in the indoor heat exchanger 41. Here, a centrifugal fan or a multi-blade fan or the like driven by an indoor fan motor 42*a* is used as the indoor fan 42.

<Outdoor Unit>

The outdoor unit 2 is installed outdoors and configures part of the refrigerant circuit 10. The outdoor unit 2 mainly has a compressor 21, a four-way switching valve 22, an outdoor heat exchanger 23, an expansion valve 24, a liquid-side stop valve 25, and a gas-side stop valve 26.

The compressor 21 is a device that compresses refrigerant at a low pressure in the refrigeration cycle to a high pressure. The compressor 21 has a closed structure where a rotary-type or scroll-type positive-displacement compression element (not shown in the drawings) is driven to rotate by a compressor motor 21*a*. The compressor 21 has a suction pipe 31 connected to its suction side and a discharge pipe 32 connected to its discharge side. The suction pipe 31 is a refrigerant pipe that interconnects the suction side of the compressor 21 and the four-way switching valve 22. The discharge pipe 32 is a refrigerant pipe that interconnects the discharge side of the compressor 21 and the four-way switching valve 22.

The four-way switching valve 22 is a switching valve for switching the direction of the flow of the refrigerant in the refrigerant circuit 10. During the cooling operation the four-way switching valve 22 switches to a cooling cycle state in which it causes the outdoor heat exchanger 23 to function as a radiator of the refrigerant that has been compressed in the compressor 21 and causes the indoor heat exchanger 41 to function as an evaporator of the refrigerant that has radiated heat in the outdoor heat exchanger 23. That is, during the cooling operation the four-way switching valve 22 interconnects the discharge side of the compressor 21 (here, the discharge pipe 32) and the gas side of the outdoor heat exchanger 23 (here, a first gas refrigerant pipe 33) (see the solid lines of the four-way switching valve 22 in FIG. 1). Moreover, the four-way switching valve 22 interconnects the suction side of the compressor 21 (here, the suction pipe 31) and the gas refrigerant connection pipe 6 side (here, a second gas refrigerant pipe 34) (see the solid lines of the four-way switching valve 22 in FIG. 1). Furthermore, during the heating operation the four-way switching valve 22 switches to a heating cycle state in which it causes the outdoor heat exchanger 23 to function as an evaporator of the refrigerant that has radiated heat in the indoor heat exchanger 41 and causes the indoor heat exchanger 41 to function as a radiator of the refrigerant that has been compressed in the compressor 21. That is, during the heating operation the four-way switching valve 22 interconnects the discharge side of the compressor 21 (here, the discharge pipe 32) and the gas refrigerant connection pipe 6 side (here, the second gas refrigerant pipe 34) (see the dashed lines of the four-way switching valve 22 in FIG. 1). Moreover, the four-way switching valve 22 interconnects the suction side of the compressor 21 (here, the suction pipe 31) and the gas side of the outdoor heat exchanger 23 (here, the first gas refrigerant pipe 33) (see the dashed lines of the four-way switching valve 22 in FIG. 1). Here, the first gas refrigerant pipe 33 is a refrigerant pipe that interconnects the four-way switching valve 22 and the gas side of the outdoor heat exchanger 23. The second gas refrigerant pipe 34 is a refrigerant pipe that interconnects the four-way switching valve 22 and the gas-side stop valve 26.

The outdoor heat exchanger 23 is a heat exchanger which, during the cooling operation, functions as a refrigerant radiator using outdoor air as a cooling source and which, during the heating operation, functions as a refrigerant evaporator using outdoor air as a heating source. The liquid side of the outdoor heat exchanger 23 is connected to a liquid refrigerant pipe 35, and the gas side of the outdoor heat exchanger 23 is connected to the first gas refrigerant pipe 33. The liquid refrigerant pipe 35 is a refrigerant pipe that interconnects the liquid side of the outdoor heat exchanger 23 and the liquid refrigerant connection pipe 5 side.

The expansion valve 24 is a valve which, during the cooling operation, reduces the pressure of refrigerant at a high pressure in the refrigeration cycle that has radiated heat in the outdoor heat exchanger 23 to a low pressure in the refrigeration cycle. Furthermore, the expansion valve 24 is a valve which, during the heating operation, reduces the pressure of refrigerant at a high pressure in the refrigeration cycle that has radiated heat in the indoor heat exchanger 41 to a low pressure in the refrigeration cycle. The expansion valve 24 is provided in a part of the liquid refrigerant pipe 35 near the liquid-side stop valve 25. Here, an electrically powered expansion valve is used as the expansion valve 24.

The liquid-side stop valve 25 and the gas-side stop valve 26 are valves provided in openings connecting to external devices and pipes (specifically, the liquid refrigerant connection pipe 5 and the gas refrigerant connection pipe 6). The liquid-side stop valve 25 is provided in the end portion of the liquid refrigerant pipe 35. The gas-side stop valve 26 is provided in the end portion of the second gas refrigerant pipe 34.

The outdoor unit 2 has an outdoor fan 36 for sucking outdoor air into the outdoor unit 2, allowing the outdoor air to exchange heat with refrigerant in the outdoor heat exchanger 23, and discharging the air to the outside. That is, the outdoor unit 2 has the outdoor fan 36 as a fan that supplies to the outdoor heat exchanger 23 the outdoor air serving as a cooling source or a heating source for the refrigerant flowing in the outdoor heat exchanger 23. Here, a propeller fan or the like driven by an outdoor fan motor 36*a* is used as the outdoor fan 36.

<Refrigerant Connection Pipes>

The refrigerant connection pipes 5 and 6 are refrigerant pipes constructed on site when installing the air conditioning apparatus 1 in an installation location such as a building, and pipes having a variety of lengths and pipe diameters are used in accordance with installation conditions such as the installation location and the combination of the outdoor unit 2 and the indoor unit 4.

(2) Basic Operation of Air Conditioning Apparatus

Next, the basic operation of the air conditioning apparatus 1 will be described using FIG. 1. The air conditioning apparatus 1 can perform the cooling operation and the heating operation as its basic operation.

<Cooling Operation>

During the cooling operation the four-way switching valve 22 is switched to the cooling cycle state (the state indicated by the solid lines in FIG. 1).

In the refrigerant circuit 10, gas refrigerant at a low pressure in the refrigeration cycle is sucked into the compressor 21, compressed to a high pressure in the refrigeration cycle, and thereafter discharged.

The high-pressure gas refrigerant that has been discharged from the compressor 21 is sent through the four-way switching valve 22 to the outdoor heat exchanger 23.

The high-pressure gas refrigerant that has been sent to the outdoor heat exchanger 23 exchanges heat with outdoor air supplied as a cooling source by the outdoor fan 36, radiates heat, and becomes high-pressure liquid refrigerant in the outdoor heat exchanger 23 functioning as a refrigerant radiator.

The high-pressure liquid refrigerant that has radiated heat in the outdoor heat exchanger 23 is sent to the expansion valve 24.

The high-pressure liquid refrigerant that has been sent to the expansion valve 24 has its pressure reduced to a low pressure in the refrigeration cycle by the expansion valve 24 and becomes refrigerant in a low-pressure gas-liquid two-phase state. The refrigerant in the low-pressure gas-liquid two-phase state whose pressure has been reduced by the expansion valve 24 is sent through the liquid-side stop valve 25 and the liquid refrigerant connection pipe 5 to the indoor heat exchanger 41.

The refrigerant in the low-pressure gas-liquid two-phase state that has been sent to the indoor heat exchanger 41 exchanges heat with room air supplied as a heating source by the indoor fan 42 and evaporates in the indoor heat exchanger 41. Because of this, the room air is cooled and thereafter supplied to the room; thus, cooling of the room takes place.

The low-pressure gas refrigerant that has evaporated in the indoor heat exchanger 41 travels through the gas refrigerant connection pipe 6, the gas-side stop valve 26, and the four-way switching valve 22 and is sucked back into the compressor 21.

<Heating Operation>

During the heating operation the four-way switching valve 22 is switched to the heating cycle state (the state indicated by the dashed lines in FIG. 1).

In the refrigerant circuit 10, gas refrigerant at a low pressure in the refrigeration cycle is sucked into the compressor 21, compressed to a high pressure in the refrigeration cycle, and thereafter discharged.

The high-pressure gas refrigerant that has been discharged from the compressor 21 is sent through the four-way switching valve 22, the gas-side stop valve 26, and the gas refrigerant connection pipe 6 to the indoor heat exchanger 41.

The high-pressure gas refrigerant that has been sent to the indoor heat exchanger 41 exchanges heat with room air supplied as a cooling source by the indoor fan 42, radiates heat, and becomes high-pressure liquid refrigerant in the indoor heat exchanger 41. Because of this, the room air is heated and thereafter supplied to the room; thus, heating of the room takes place.

The high-pressure liquid refrigerant that has radiated heat in the indoor heat exchanger 41 is sent through the liquid refrigerant connection pipe 5 and the liquid-side stop valve 25 to the expansion valve 24.

The high-pressure liquid refrigerant that has been sent to the expansion valve 24 has its pressure reduced to a low pressure in the refrigeration cycle by the expansion valve 24 and becomes refrigerant in a low-pressure gas-liquid two-phase state. The refrigerant in the low-pressure gas-liquid two-phase state whose pressure has been reduced by the expansion valve 24 is sent to the outdoor heat exchanger 23.

The refrigerant in the low-pressure gas-liquid two-phase state that has been sent to the outdoor heat exchanger 23 exchanges heat with outdoor air supplied as a heating source by the outdoor fan 36, evaporates, and becomes low-pressure gas refrigerant in the outdoor heat exchanger 23 functioning as a refrigerant evaporator.

The low-pressure refrigerant that has evaporated in the outdoor heat exchanger 23 travels through the four-way switching valve 22 and is sucked back into the compressor 21.

(3) Basic Configuration of Outdoor Unit

Figure 2:
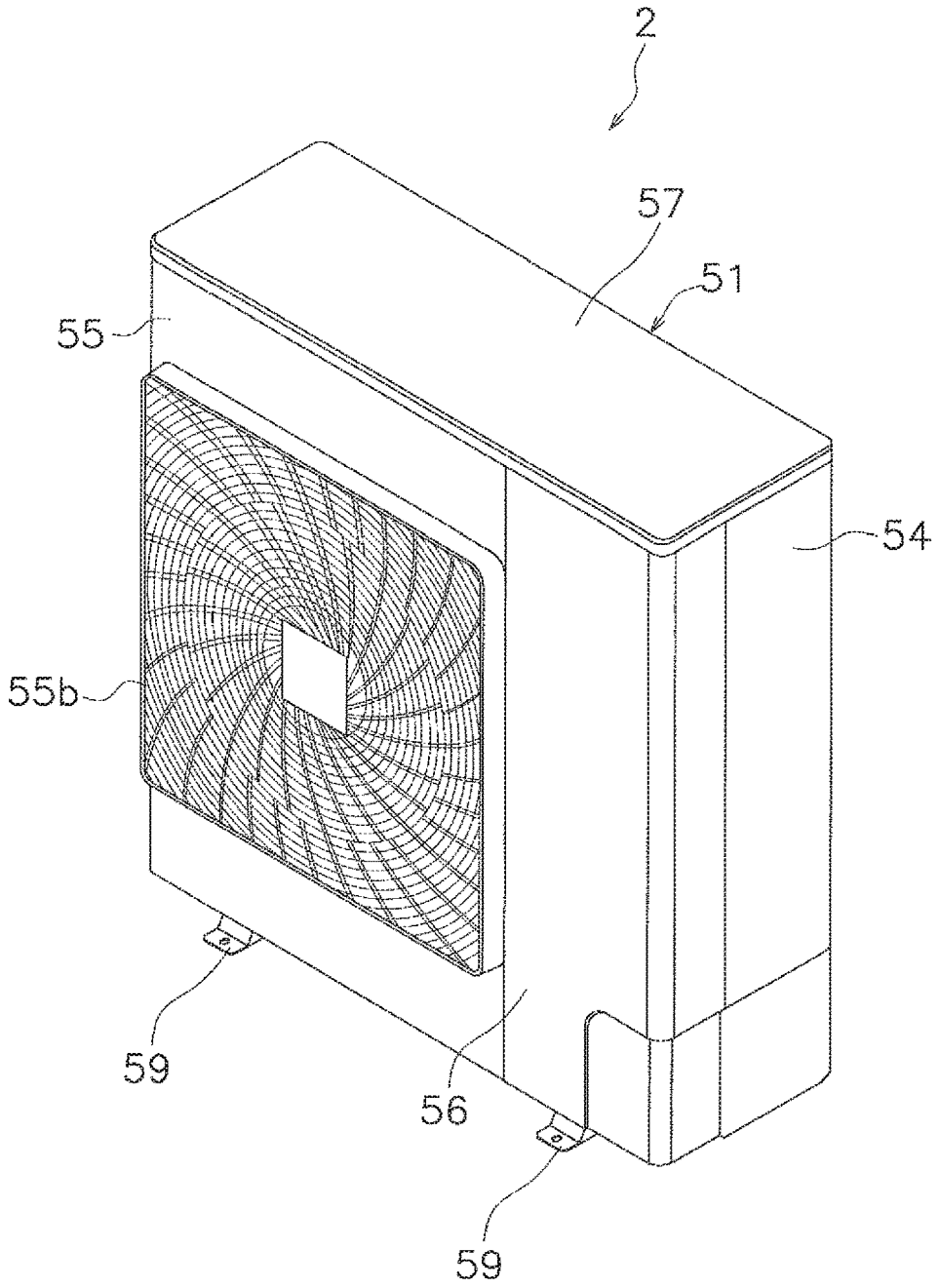
FIG. 2 is a perspective view showing the outer appearance of an outdoor unit.
Figure 3:
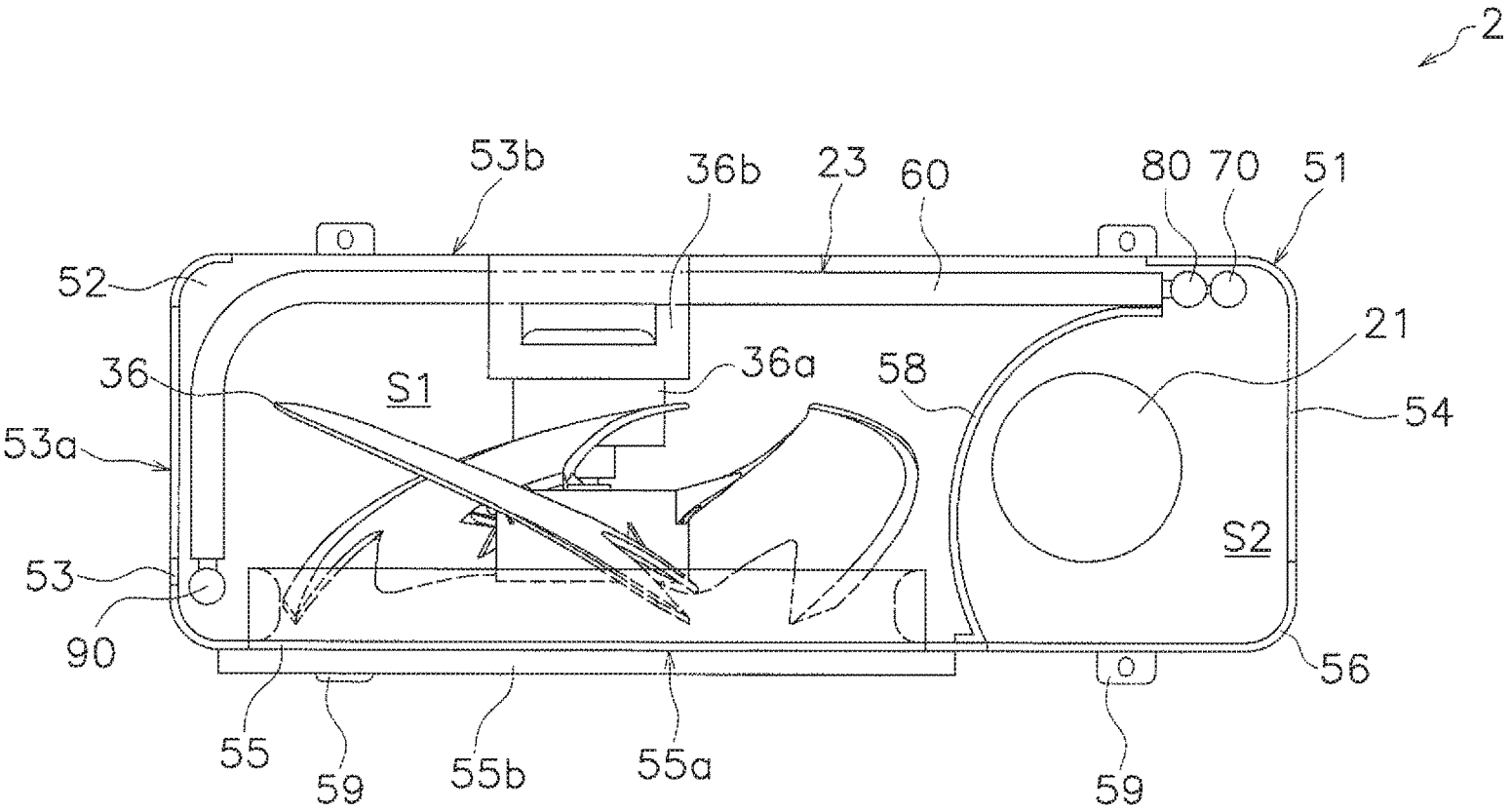
FIG. 3 is a plan view showing a state in which a top plate of the outdoor unit has been removed.
Figure 4:
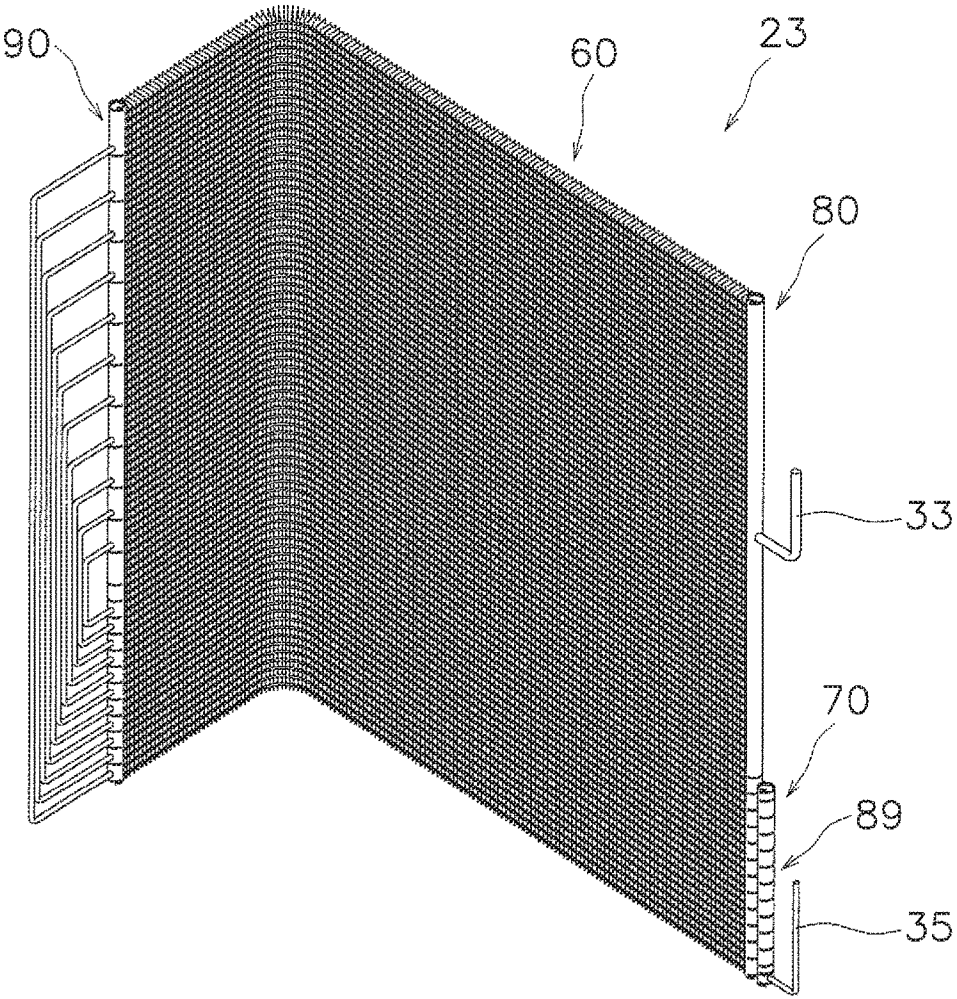
FIG. 4 is a general perspective view of the outdoor heat exchanger.

Next, the basic configuration of the outdoor unit 2 will be described using FIG. 1 to FIG. 4. Here, FIG. 2 is a perspective view showing the outer appearance of the outdoor unit 2. FIG. 3 is a plan view showing a state in which a top plate 57 of the outdoor unit 2 has been removed. FIG. 4 is a general perspective view of the outdoor heat exchanger 23. It should be noted that unless otherwise specified terms such as "upper," "lower," "left," "right," "vertical," "front surface," "side surface," "back surface," "top surface," and "bottom surface" in the following description mean directions and surfaces in a case where the surface on a fan outlet grille 55*b* side is taken to be the front surface.

The outdoor unit 2 has a structure (a so-called trunk structure) where the inside of a unit casing 51 is partitioned into a blower compartment S1 and a machine compartment S2 by a partition plate 58 extending in the up and down direction. The outdoor unit 2 is configured to suck outdoor air inside from part of the back surface and side surface of the unit casing 51 and thereafter discharge the air from the front surface of the unit casing 51. The outdoor unit 2 mainly has: the unit casing 51, the devices and pipes configuring the refrigerant circuit 10, including the compressor 21, the four-way switching valve 22, the outdoor heat exchanger 23, the expansion valve 24, the stop valves 25 and 26, and the refrigerant pipes 31 to 35 interconnecting these devices; and the outdoor fan 36 and the outdoor fan motor 36*a*. It should be noted that although an example is described here where the blower compartment S1 is formed near the left side surface of the unit casing 51 and the machine compartment S2 is formed near the right side surface of the unit casing 51, right and left may also be reversed.

The unit casing 51 is formed in a substantially cuboid shape and mainly houses: the devices and pipes configuring the refrigerant circuit 10, including the compressor 21, the four-way switching valve 22, the outdoor heat exchanger 23, the expansion valve 24, the stop valves 25 and 26, and the refrigerant pipes 31 to 35 interconnecting these devices; and the outdoor fan 36 and the outdoor fan motor 36*a*. The unit casing 51 has a bottom frame 52, on which the devices and pipes 21 to 26 and 31 to 35 configuring the refrigerant circuit 10 and the outdoor fan 36 or the like are placed, a blower compartment-side side plate 53, a machine compartment-side side plate 54, a blower compartment-side front plate 55, a machine compartment-side front plate 56, a top plate 57, and two mounting feet 59.

The bottom frame 52 is a plate-shaped member configuring the bottom surface part of the unit casing 51.

The blower compartment-side side plate 53 is a plate-shaped member configuring the side surface part (here, the left side surface part) of the unit casing 51 near the blower compartment S1. The lower portion of the blower compartment-side side plate 53 is secured to the bottom frame 52. In the blower compartment-side side plate 53, there is formed a side surface fan inlet 53*a* for the outdoor fan 36 to suck outdoor air into the unit casing 51 from the side surface side of the unit casing 51.

The machine compartment side-side plate 54 is a plate-shaped member configuring part of the side surface part (here, the right side surface part) of the unit casing 51 near the machine compartment S2 and the back surface part of the unit casing 51 near the machine compartment S2. The lower portion of the machine compartment-side side plate 54 is secured to the bottom frame 52. Between the end portion of the blower compartment-side side plate 53 on the back surface side and the end portion of the machine compartment-side side plate 54 on the blower compartment S1 side, there is formed a back surface fan inlet 53*b* for the outdoor fan 36 to suck outdoor air into the unit casing 51 from the back surface side of the unit casing 51.

The blower compartment-side front plate 55 is a plate-shaped member configuring the front surface part of the blower compartment S1 of the unit casing 51. The lower portion of the blower compartment-side front plate 55 is secured to the bottom frame 52, and the end portion of the blower compartment-side front plate 55 on the left side surface side is secured to the end portion of the blower compartment-side side plate 53 on the front surface side. The blower compartment-side front plate 55 is provided with a fan outlet 55*a* for the outdoor fan 36 to blow out to the outside the outdoor air that has been sucked into the unit casing 51. The front surface side of the blower compartment-side front plate 55 is provided with a fan outlet grille 55*b* that covers the fan outlet 55*a*.

The machine compartment-side front plate 56 is a plate-shaped member configuring part of the front surface part of the machine compartment S2 of the unit casing 51 and part of the side surface part of the machine compartment S2 of the unit casing 51. The end portion of the machine compartment-side front plate 56 on the blower compartment S1 side is secured to the end portion of the blower compartment-side front plate 55 on the machine compartment S2 side, and the end portion of the machine compartment-side front plate 56 on the back surface side is secured to the end portion of the machine compartment-side side plate 54 on the front surface side.

The top plate 57 is a plate-shaped member configuring the top surface part of the unit casing 51. The top plate 57 is secured to the blower compartment-side side plate 53, the machine compartment-side side plate 54, and the blower compartment-side front plate 55.

The partition plate 58 is a plate-shaped member disposed on the bottom frame 52 and extending in the vertical direction. The partition plate 58 here partitions the inside of the unit casing 51 into right and left to form the blower compartment S1 near the left side surface and the machine compartment S2 near the right side surface. The lower portion of the partition plate 58 is secured to the bottom frame 52, the end portion of the partition plate 58 on the front surface side is secured to the blower compartment-side front plate 55, and the end portion of the partition plate 58 on the back surface side extends as far as the side end portion of the outdoor heat exchanger 23 near the machine compartment S2.

The mounting feet 59 are plate-shaped members extending in the front and rear direction of the unit casing 51. The mounting feet 59 are members secured to a mounting surface of the outdoor unit 2. Here, the outdoor unit 2 has two mounting feet 59, with one being disposed near the blower compartment S1 and the other being disposed near the machine compartment S2.

The outdoor fan 36 is a propeller fan having plural blades, and is disposed inside the blower compartment S1 in a position on the front surface side of the outdoor heat exchanger 23 so as to oppose the front surface (here, the fan outlet 55*a*) of the unit casing 51. The outdoor fan motor 36*a* is disposed inside the blower compartment S1 between the outdoor fan 36 and the outdoor heat exchanger 23 in the front and rear direction. The outdoor fan motor 36*a* is supported by a motor support stand 36*b* placed on the bottom frame 52. Additionally, the outdoor fan 36 is pivotally supported by the outdoor fan motor 36*a*.

The outdoor heat exchanger 23 is a heat exchanger panel having a substantially L-shape as seen in a plan view, and is placed on the bottom frame 52 inside the blower compartment S1 so as to oppose the side surface (here, the left side surface) and the back surface of the unit casing 51.

The compressor 21 here is a closed compressor having the shape of an upright open cylinder and is placed on the bottom frame 52 inside the machine compartment S2.

(4) Basic Configuration of Outdoor Heat Exchanger

Figure 5:
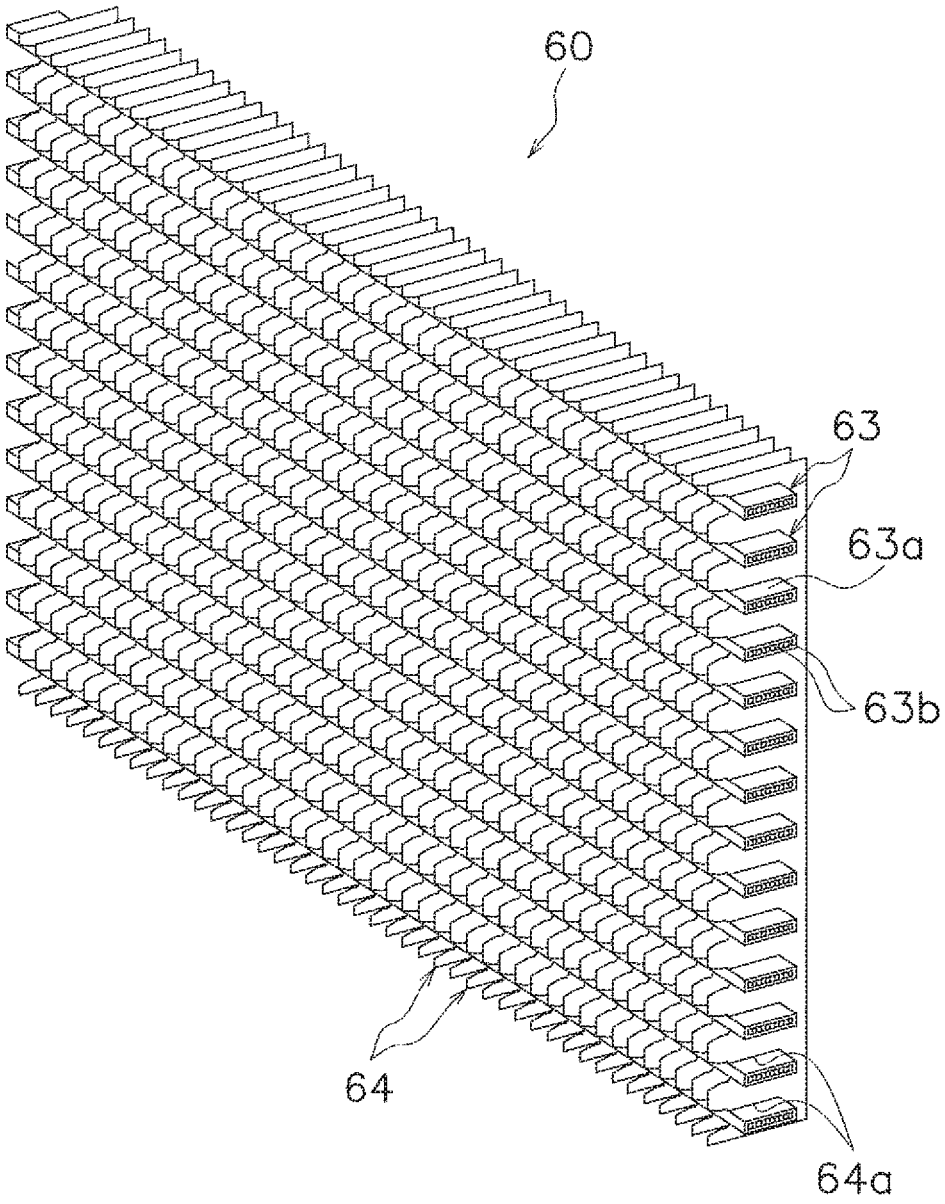
FIG. 5 is a partial enlarged view of a heat exchange section of FIG. 4.
Figure 6:
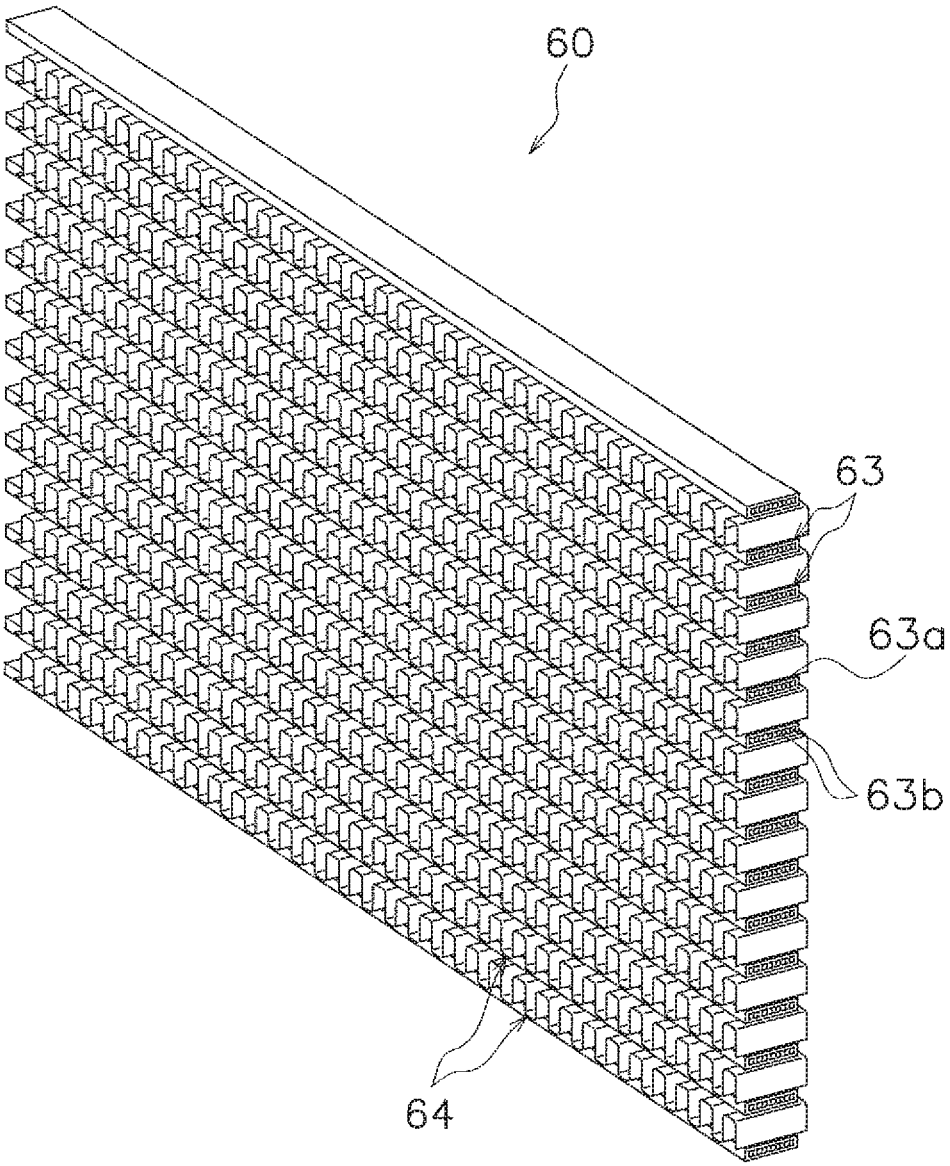
FIG. 6 is a drawing corresponding to FIG. 5 in a case where corrugated fins are employed as heat transfer fins.
Figure 7:
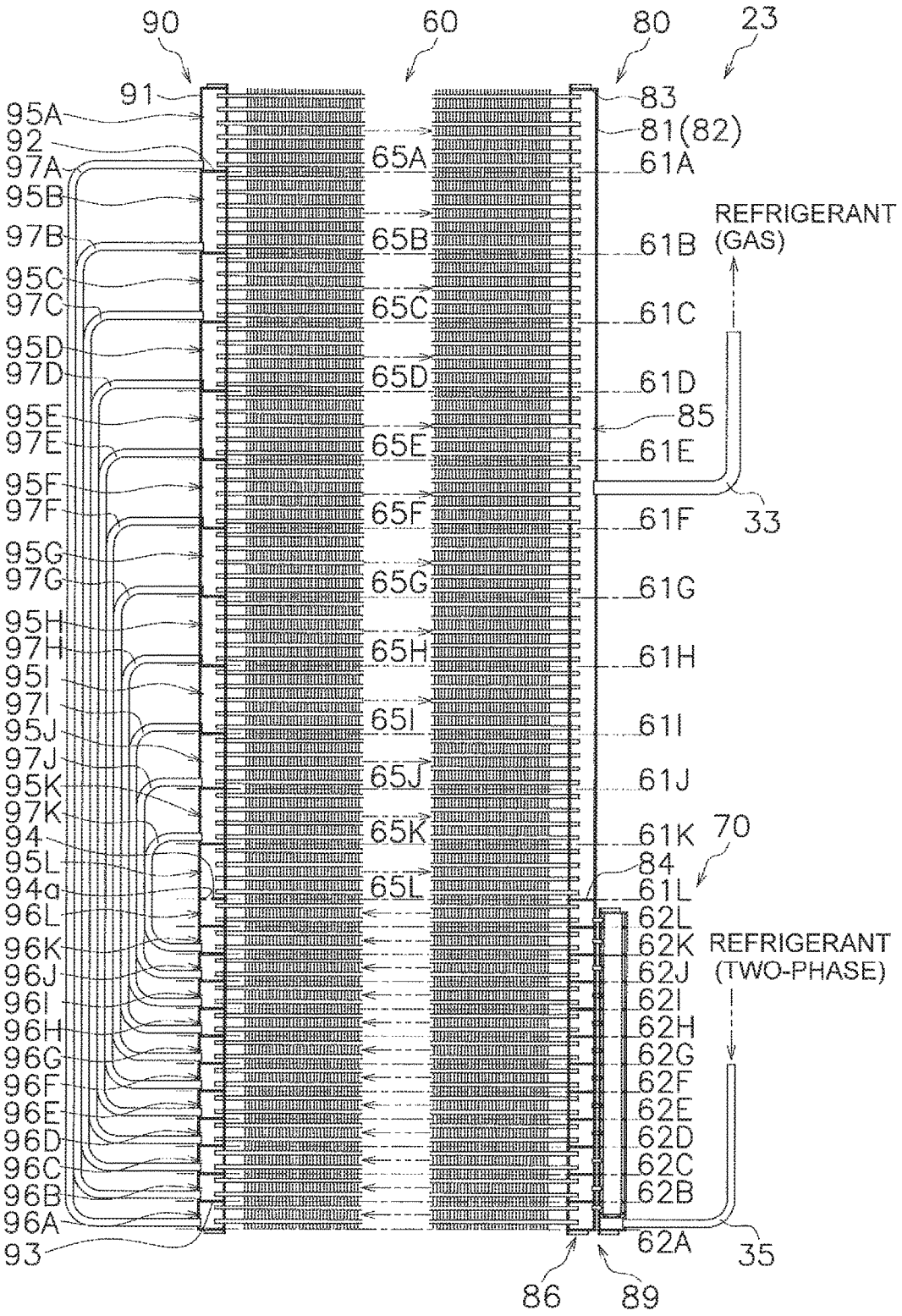
FIG. 7 is a general configuration drawing of the outdoor heat exchanger.

Next, the configuration of the outdoor heat exchanger 23 will be described using FIG. 1 to FIG. 7. Here, FIG. 5 is a partial enlarged view of a heat exchange section 60 of FIG. 4. FIG. 6 is a drawing corresponding to FIG. 5 in a case where corrugated fins are employed as heat transfer fins 64. FIG. 7 is a general configuration drawing of the outdoor heat exchanger 23. It should be noted that unless otherwise specified terms indicating directions and surfaces in the following description mean directions and surfaces using as a reference a state in which the outdoor heat exchanger 23 is placed in the outdoor unit 2.

The outdoor heat exchanger 23 mainly has a heat exchange section 60 that performs heat exchange between the outdoor air and the refrigerant, a refrigerant distributor 70 and an inlet/outlet header 80 that are provided on one end side of the heat exchange section 60, and an intermediate header 90 that is provided on the other end side of the heat exchange section 60. The outdoor heat exchanger 23 is an all-aluminum heat exchanger in which the refrigerant distributor 70, the inlet/outlet header 80, the intermediate header 90, and the heat exchange section 60 are all made of aluminum or aluminum alloy, and the joining together of the various parts is carried out by brazing such as brazing in a furnace.

The heat exchanger section 60 has plural (here, twelve) primary heat exchange sections 61A to 61L configuring the upper portion of the outdoor heat exchanger 23 and plural (here, twelve) secondary heat exchange sections 62A to 62L configuring the lower portion of the outdoor heat exchanger 23. In the primary heat exchange sections 61A to 61L, the primary heat exchange section 61A is disposed in the uppermost tier, and the primary heat exchange sections 61B to 61L are disposed in sequential order heading downward in the vertical direction beginning with the tier below the primary heat exchange section 61A. In the secondary heat exchange sections 62A to 62L, the secondary heat exchange section 62A is disposed in the lowermost tier, and the secondary heat exchange sections 62B to 62L are disposed in sequential order heading upward in the vertical direction beginning with the tier above the secondary heat exchange section 62A.

The heat exchange section 60 is an inserted fin-type heat exchanger configured by numerous heat transfer tubes 63 including flat tubes and numerous heat transfer fins 64 comprising inserted fins. The heat transfer tubes 63 are multi-hole flat tubes made of aluminum or aluminum alloy and having planar portions 63*a*, which face the vertical direction and serve as heat transfer surfaces, and numerous small inside flow passages 63*b*, through which the refrigerant flows. The numerous heat transfer tubes 63 are disposed in plural tiers an interval apart from each other along the vertical direction, and both ends of each of the numerous heat transfer tubes 63 are connected to the inlet/outlet header 80 and the intermediate header 90. The heat transfer fins 64 are made of aluminum or aluminum alloy, and numerous cutouts 64*a* extending in a long and narrow manner in the horizontal direction are formed in the heat transfer fins 64 so that the heat transfer fins 64 can be inserted between the numerous heat transfer tubes 63 disposed between the inlet/outlet header 80 and the intermediate header 90. The shape of the cutouts 64*a* in the heat transfer fins 64 substantially matches the outer shape of the cross section of the heat transfer tubes 63. The numerous heat transfer tubes 63 are divided into the primary heat exchange sections 61A to 61L and the secondary heat exchange sections 62A to 62L. Here, the numerous heat transfer tubes 63 form heat transfer tube groups configuring the primary heat exchange sections 61A to 61L every predetermined number (about three to eight) of the heat transfer tubes 63 heading downward in the vertical direction beginning with the uppermost tier in the outdoor heat exchanger 23. Furthermore, the numerous heat transfer tubes 63 form heat transfer tube groups configuring the secondary heat exchange sections 62A to 62L every predetermined number (about one to three) of the heat transfer tubes 63 heading upward in the vertical direction beginning with the lowermost tier in the outdoor heat exchanger 23.

It should be noted that the outdoor heat exchanger 23 is not limited to being an inserted fin-type heat exchanger employing inserted fins (see FIG. 5) as the heat transfer fins 64 such as described above and may also be a corrugated fin-type heat exchanger employing numerous corrugated fins (see FIG. 6) as the heat transfer fins 64.

(5) Configuration of Intermediate Header

Next, the configuration of the intermediate header 90 will be described using FIG. 1 to FIG. 7. It should be noted that unless otherwise specified terms indicating directions and surfaces in the following description mean directions and surfaces using as a reference a state in which the outdoor heat exchanger 23 including the intermediate header 90 is placed in the outdoor unit 2.

The intermediate header 90, as described above, is provided on the other end side of the heat exchange section 60, and the other ends of the heat transfer tubes 63 are connected to the intermediate header 90. The intermediate header 90 is a tubular member made of aluminum or aluminum alloy and extending in the vertical direction, and mainly has an intermediate header case 91 that is vertically long and hollow.

The inside space of the intermediate header case 91 is partitioned along the vertical direction by plural (here, eleven) primary-side intermediate baffles 92, plural (here, eleven) secondary-side intermediate baffles 93, and a boundary-side intermediate baffle 94. The primary-side intermediate baffles 92 are provided in sequential order along the vertical direction so as to partition the inside space of the upper portion of the intermediate header case 91 into primary-side intermediate spaces 95A to 95K communicating with the other ends of the primary heat exchange sections 61A to 61K. The secondary-side intermediate baffles 93 are provided in sequential order along the vertical direction so as to partition the inside space of the lower portion of the intermediate header case 91 into secondary-side intermediate spaces 96A to 96K communicating with the other ends of the secondary heat exchange sections 62A to 62K. The boundary-side intermediate baffle 94 is provided so as to partition the inside space of the intermediate header case 91, between the primary-side intermediate baffle 92 on the lowermost-tier side and the secondary-side intermediate baffle 93 on the uppermost-tier side in the vertical direction, into a primary-side intermediate space 95L communicating with the other end of the primary heat exchange section 61L and a secondary-side intermediate space 96L communicating with the other end of the secondary heat exchange section 62L.

Plural (here, eleven) intermediate connecting pipes 97A to 97K are connected to the intermediate header case 91. The intermediate connecting pipes 97A to 97K are refrigerant pipes that communicate the primary-side intermediate spaces 95A to 95K to the secondary-side intermediate spaces 96A to 96K. Because of this, the primary heat exchange sections 61A to 61K and the secondary heat exchange sections 62A to 62K communicate with each other via the intermediate header 90 and the intermediate connecting pipes 97A to 97K, and refrigerant paths 65A to 65K in the outdoor heat exchanger 23 are formed. Furthermore, an intermediate baffle communicating hole 94*a* that communicates the primary-side intermediate space 95L to the secondary-side intermediate space 96L is formed in the boundary-side intermediate baffle 94. Because of this, the primary heat exchange section 61L and the secondary heat exchange section 62L communicate with each other via the intermediate header 90 and the intermediate baffle communicating hole 94*a*, and a refrigerant path 65L in the outdoor heat exchanger 23 is formed. In this way, the outdoor heat exchanger 23 has a configuration divided into multiple (here, twelve) refrigerant paths 65A to 65L.

It should be noted that the intermediate header 90 is not limited to just a configuration where the inside space of the intermediate header case 91 is partitioned along the vertical direction by the intermediate baffles 92 and 93 such as described above, and may also have a configuration having means for well maintaining the flowing state of the refrigerant inside the intermediate header 90.

(6) Configurations of Inlet/Outlet Header and Refrigerant Distributor

Figure 8:
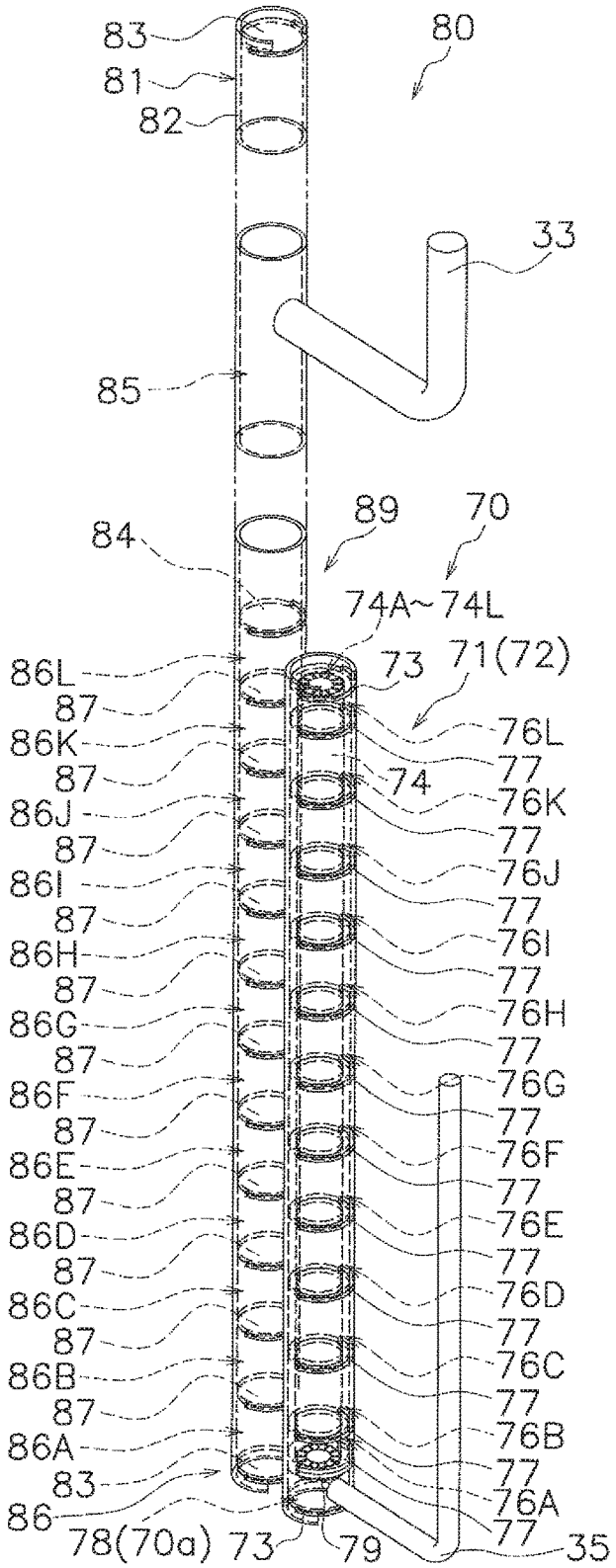
FIG. 8 is an enlarged view of an inlet/outlet header and a refrigerant distributor of FIG. 4.
Figure 9:
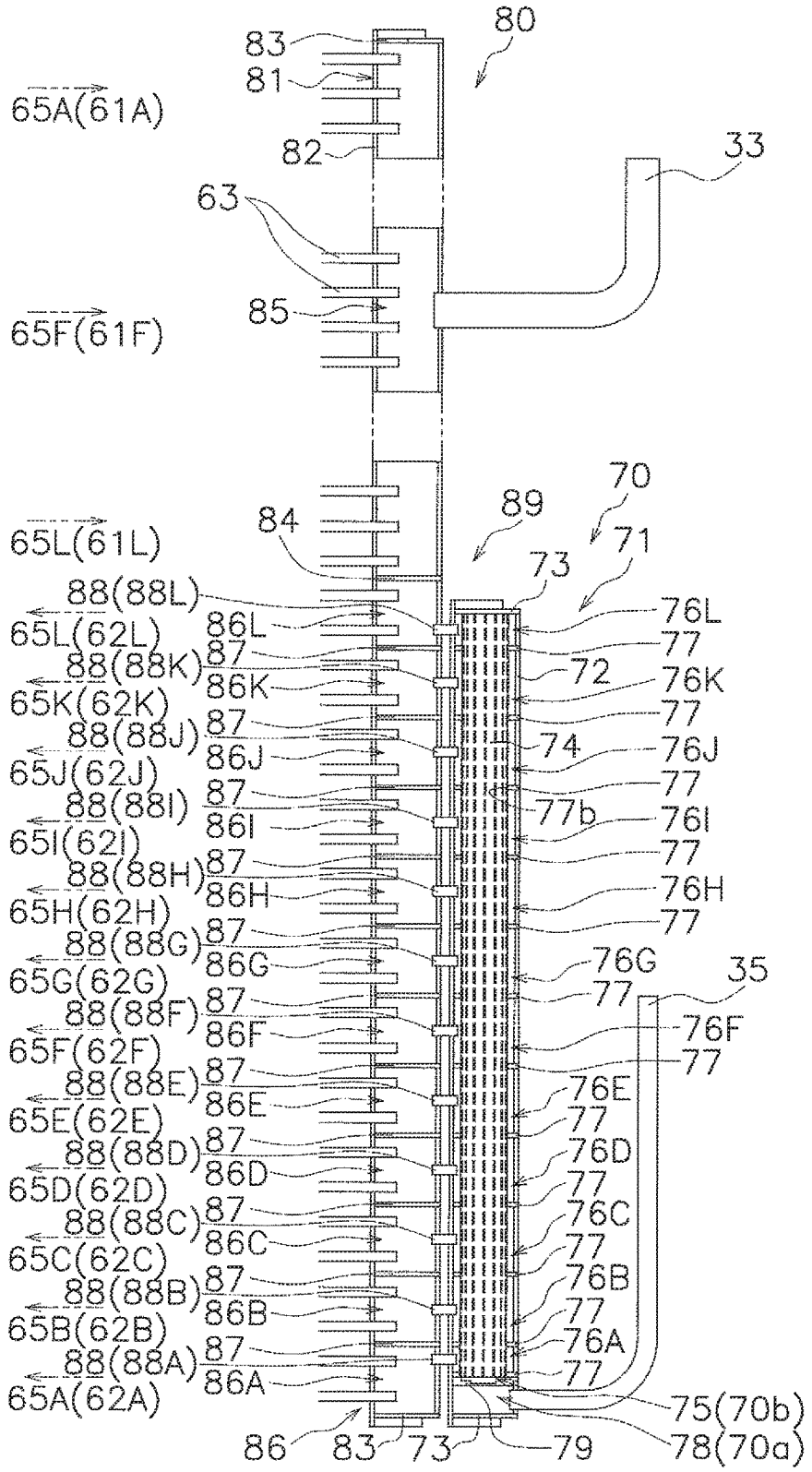
FIG. 9 is an enlarged cross-sectional view of the inlet/outlet header and the refrigerant distributor of FIG. 7.
Figure 10:
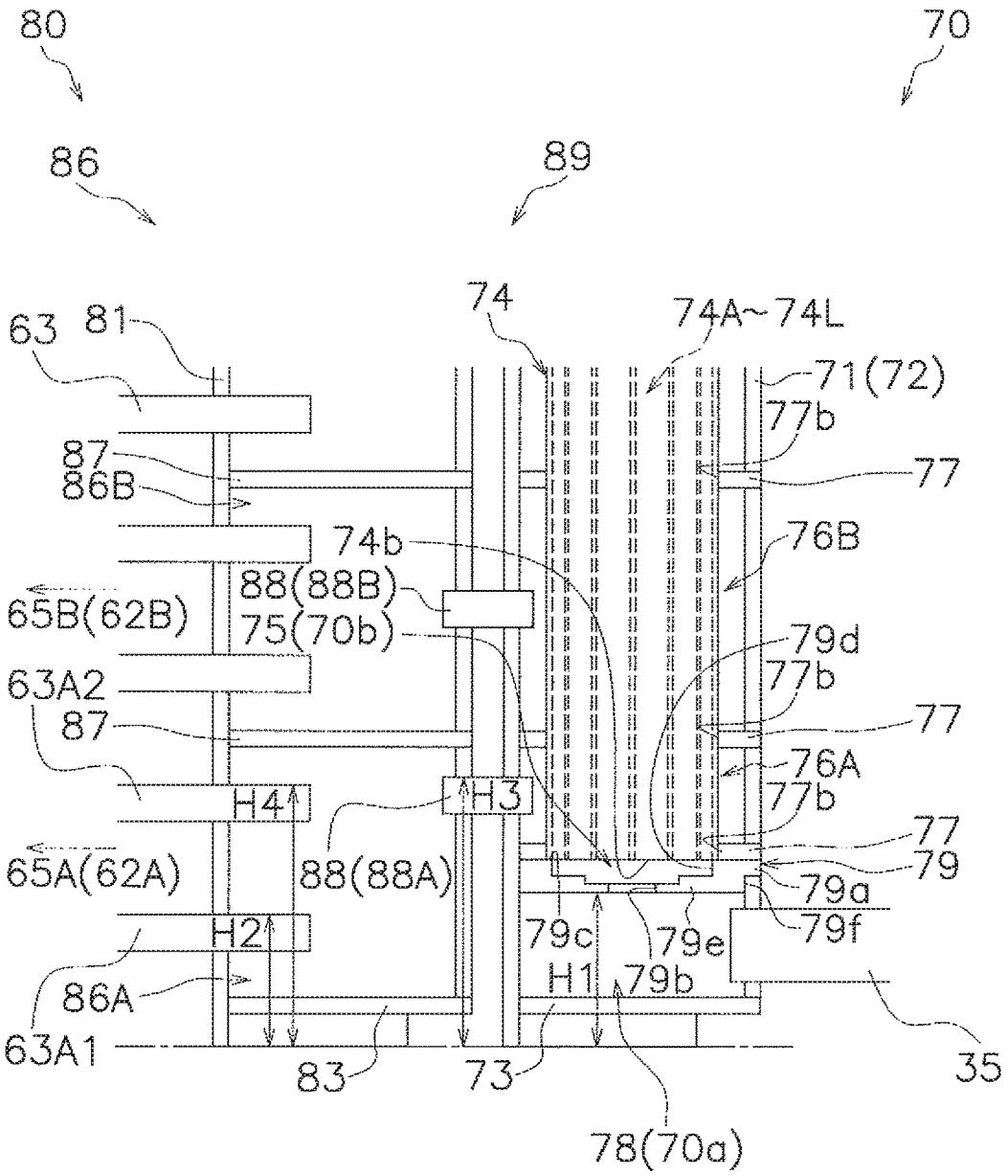
FIG. 10 is an enlarged cross-sectional view of the lower portions of the inlet/outlet header and the refrigerant distributor of FIG. 9.
Figure 11:
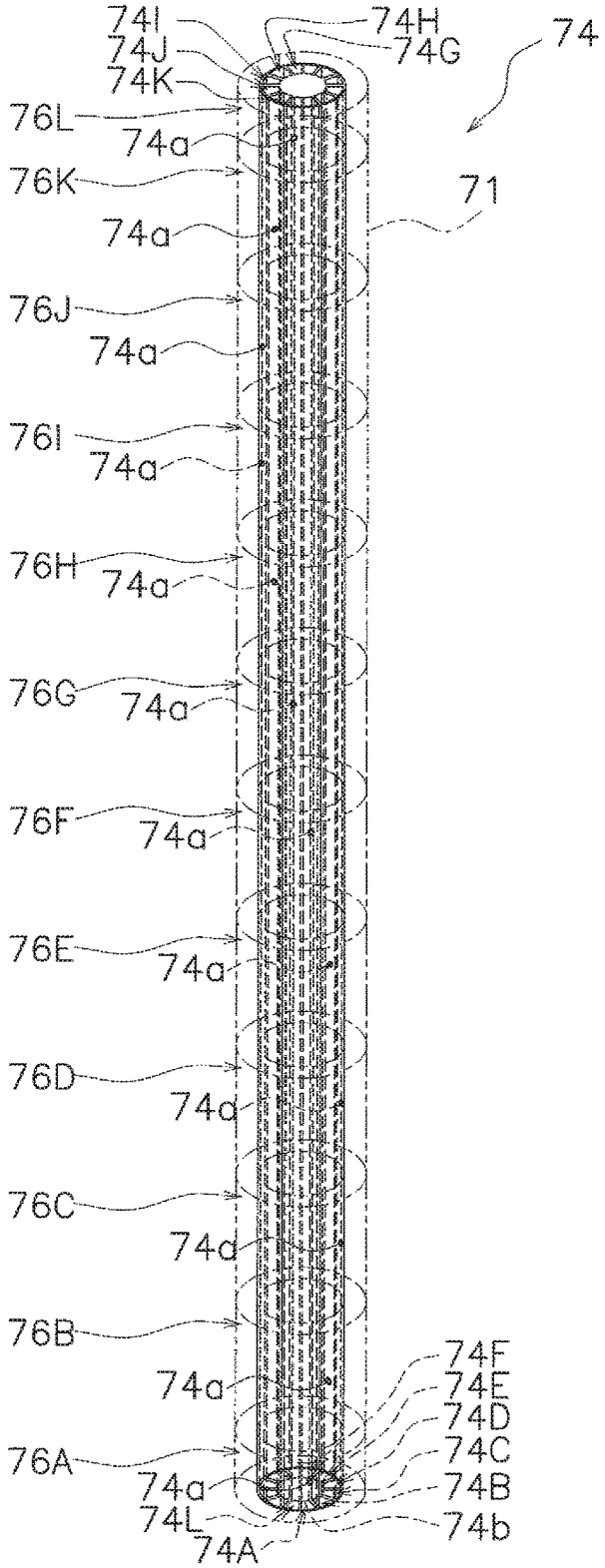
FIG. 11 is a perspective view of a rod member.
Figure 12:
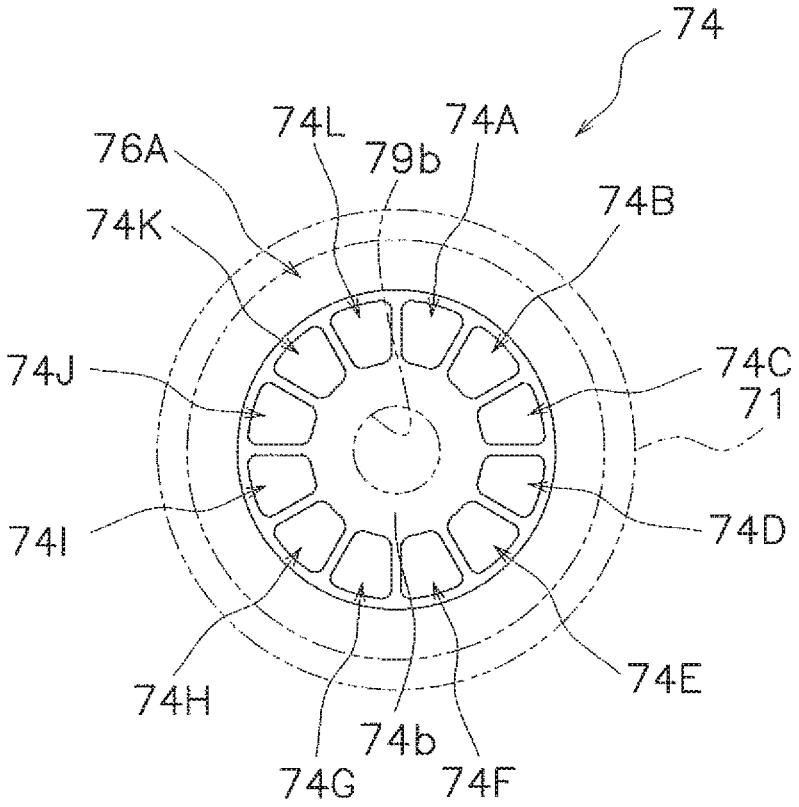
FIG. 12 is a plan view of the rod member.
Figure 13:
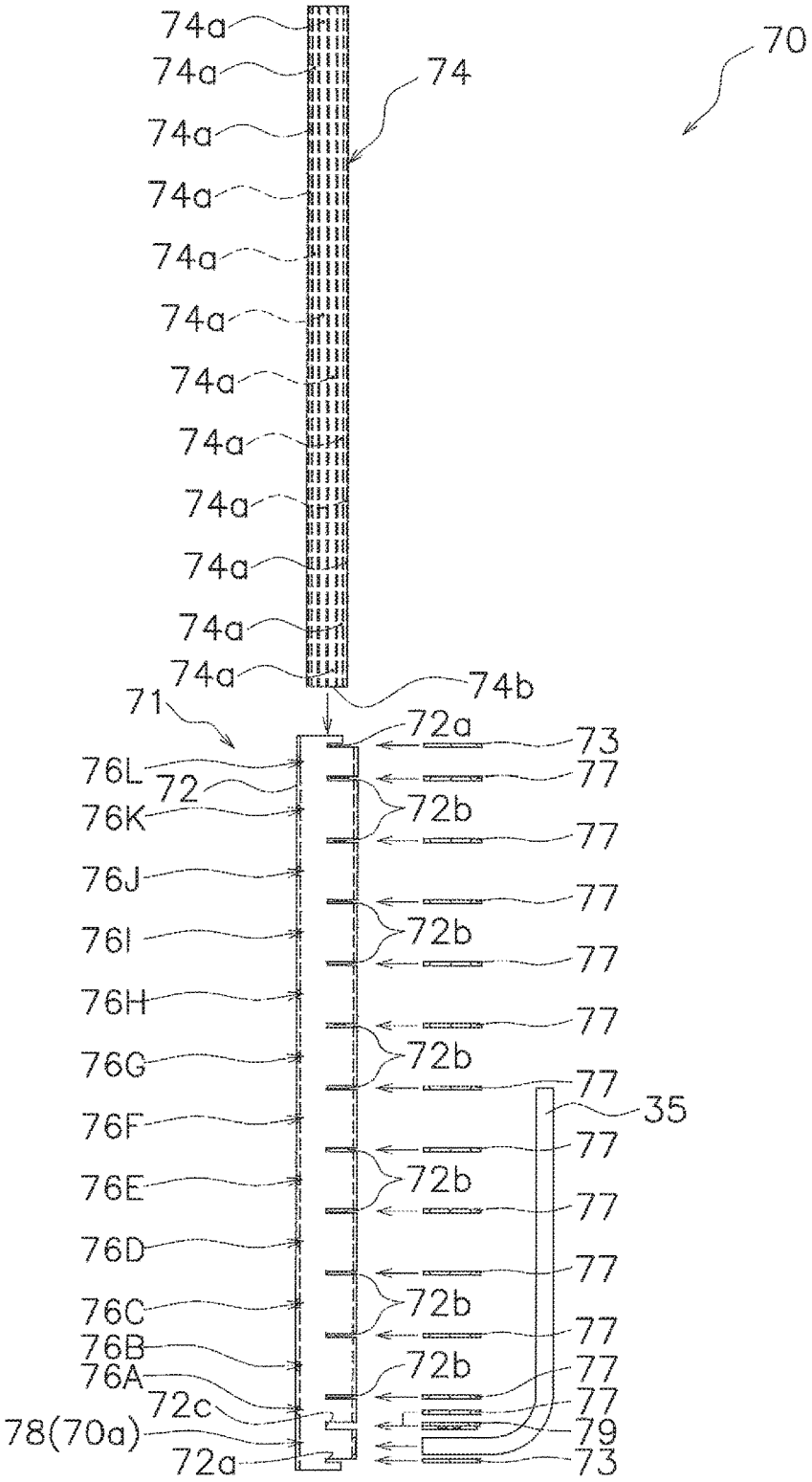
FIG. 13 is an exploded view of the refrigerant distributor.
Figure 14:
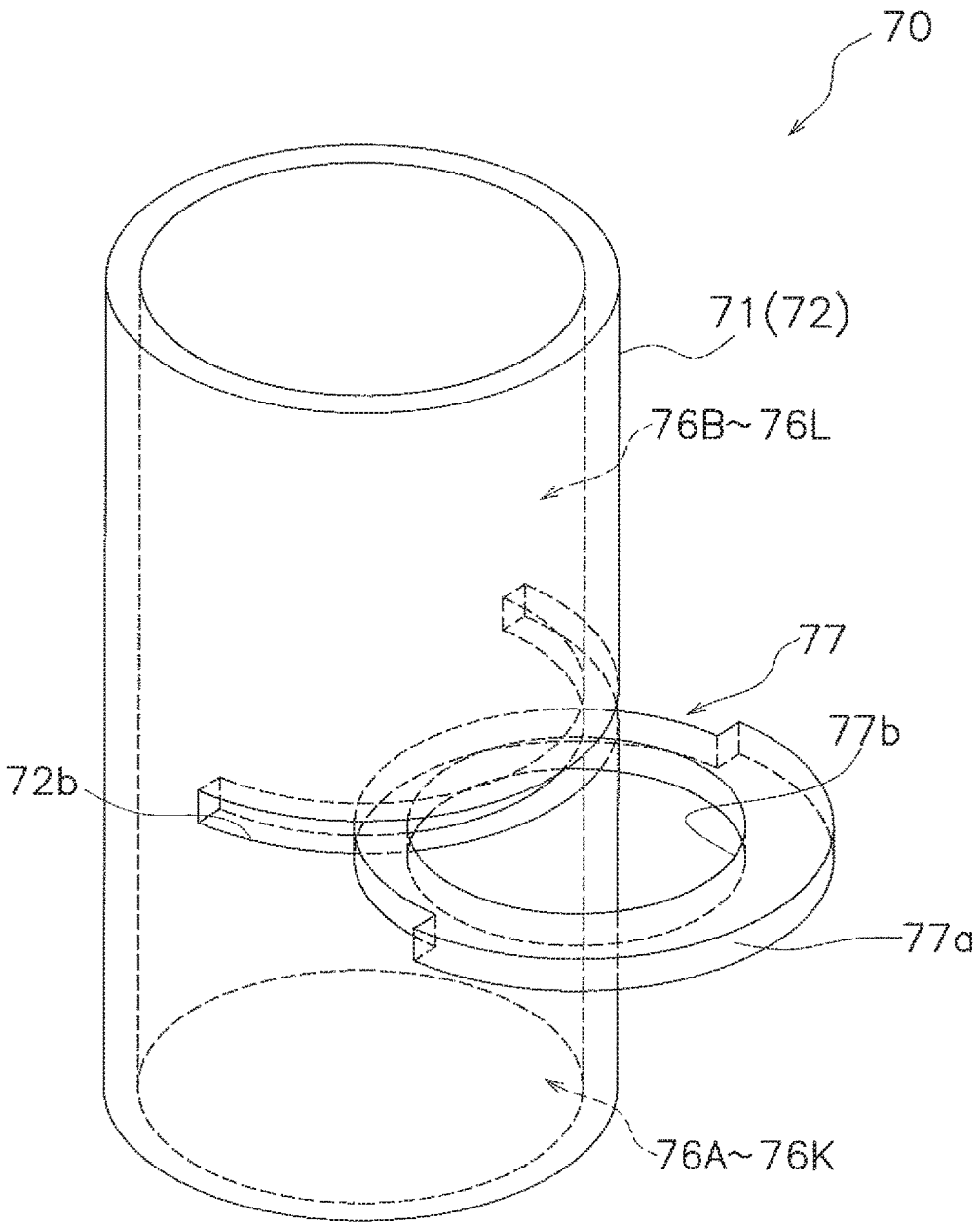
FIG. 14 is a perspective view showing a rod passing baffle being inserted into a distributor case.
Figure 15:
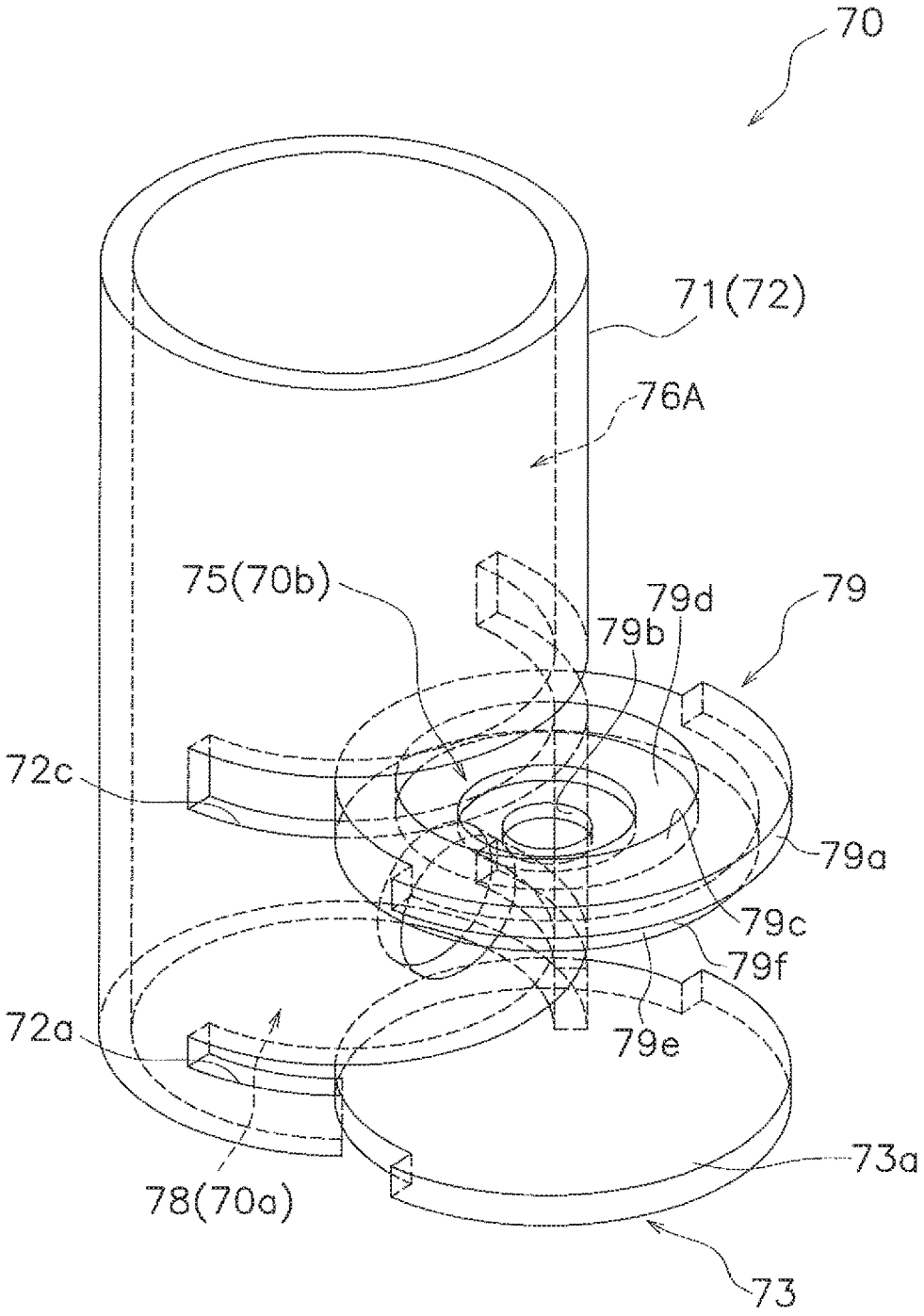
FIG. 15 is a perspective view showing a nozzle member and an upper-and-lower-end-side distribution baffle being inserted into the distributor case.
Figure 16:
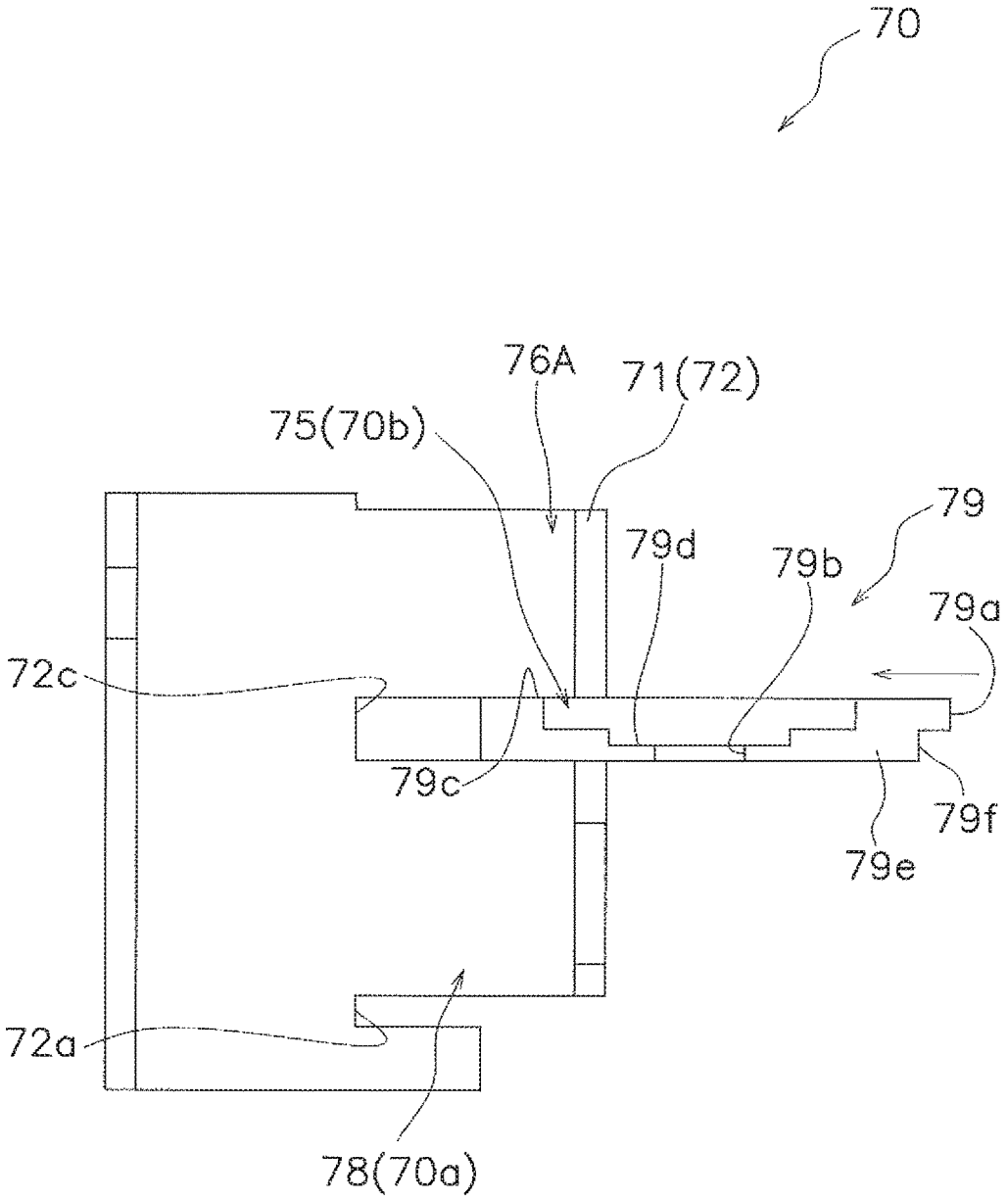
FIG. 16 is a cross-sectional view showing the nozzle member being inserted into the distributor case.
Figure 17:
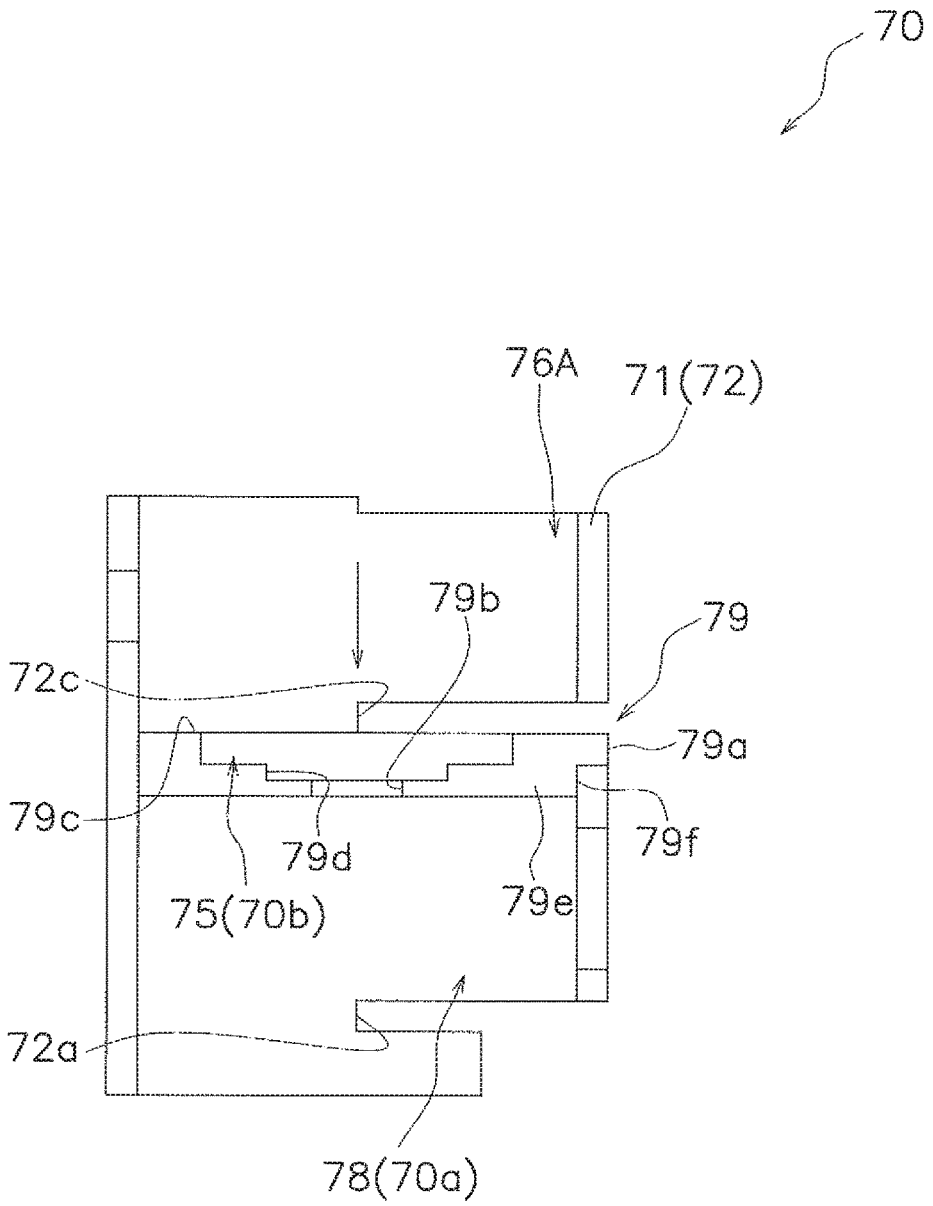
FIG. 17 is a cross-sectional view showing the nozzle member being fitted together with the distributor case.
Figure 18:
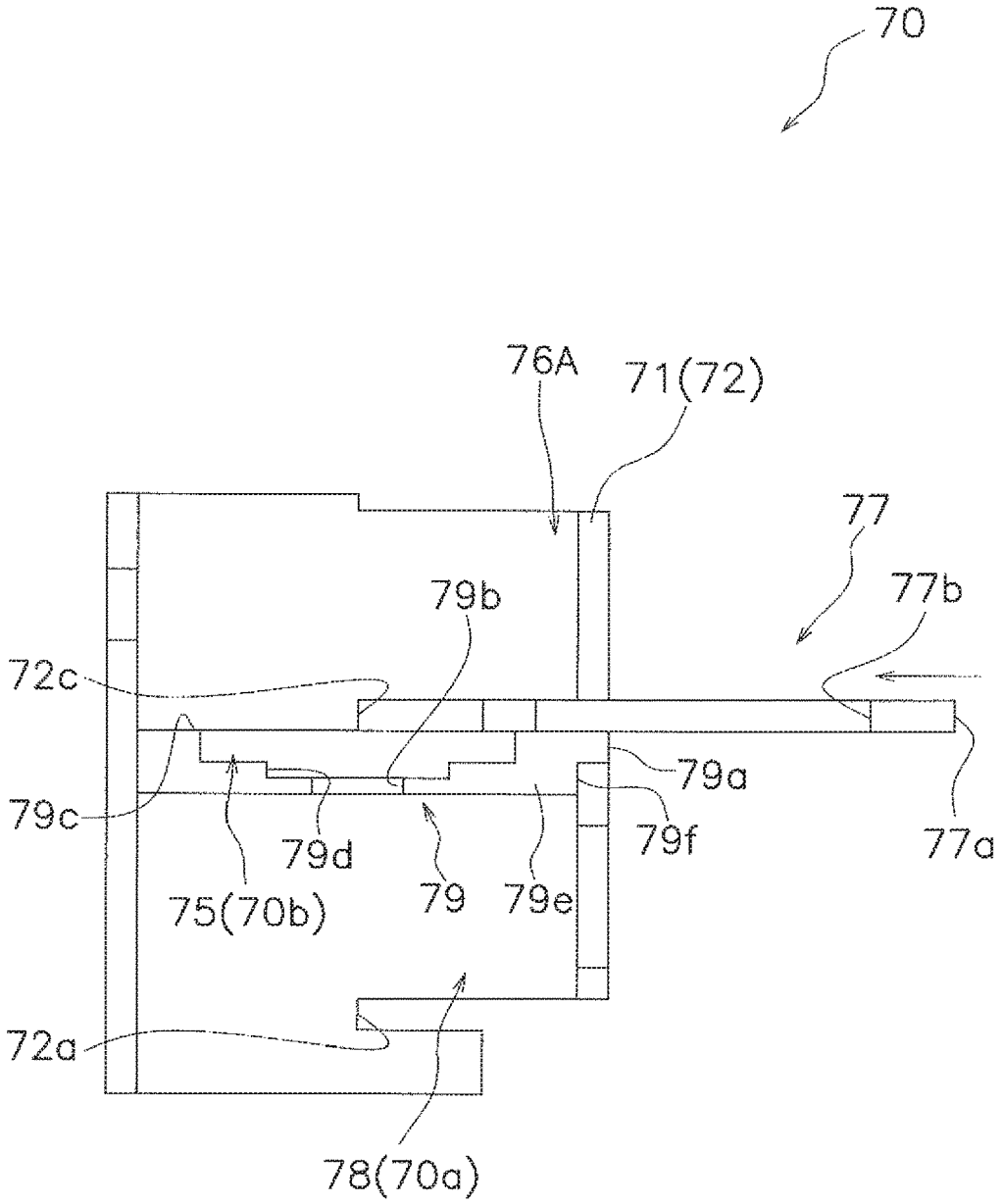
FIG. 18 is a cross-sectional view showing a gap being filled with the rod passing baffle after the nozzle member has been fitted together with the distributor case.

Next, the configurations of the inlet/outlet header 80 and the refrigerant distributor 70 will be described using FIG. 1 to FIG. 18. Here, FIG. 8 is an enlarged view of the inlet/outlet header 80 and the refrigerant distributor 70 of FIG. 4. FIG. 9 is an enlarged cross-sectional view of the inlet/outlet header 80 and the refrigerant distributor 70 of FIG. 7. FIG. 10 is an enlarged cross-sectional view of the lower portions of the inlet/outlet header 80 and the refrigerant distributor 70 of FIG. 9. FIG. 11 is a perspective view of a rod member 74. FIG. 12 is a plan view of the rod member 74. FIG. 13 is an exploded view of the refrigerant distributor 70. FIG. 14 is a perspective view showing a rod passing baffle 77 being inserted into a distributor case 71. FIG. 15 is a perspective view showing a nozzle member 79 and an upper-and-lower-end-side distribution baffle 73 being inserted into the distributor case 71. FIG. 16 is a cross-sectional view showing the nozzle member 79 being inserted into the distributor case 71. FIG. 17 is a cross-sectional view showing the nozzle member 79 being fitted together with the distributor case 71. FIG. 18 is a cross-sectional view showing a gap being filled with the rod passing baffle 77 after the nozzle member 79 has been fitted together with the distributor case 71. It should be noted that unless otherwise specified terms indicating directions and surfaces in the following description mean directions and surfaces using as a reference a state in which the outdoor heat exchanger 23 including the refrigerant distributor 70 and the inlet/outlet header 80 is placed in the outdoor unit 2. Furthermore, unless otherwise specified the flow of the refrigerant in the outdoor heat exchanger 23 including the refrigerant distributor 70, the inlet/outlet header 80, and the intermediate header 90 means the flow of the refrigerant using as a reference a case where the outdoor heat exchanger 23 functions as a refrigerant evaporator.

<Inlet/Outlet Header>

The inlet/outlet header 80, as described above, is provided on the one end side of the heat exchange section 60, and the one ends of the heat transfer tubes 63 are connected to the inlet/outlet header 80. The inlet/outlet header 80 is a member made of aluminum or aluminum alloy and extending in the vertical direction, and mainly has an inlet/outlet header case 81 that is vertically long and hollow. The inlet/outlet header case 81 mainly has an inlet/outlet header tubular body 82 having an open cylinder shape whose upper end and lower end are open, and the openings in the upper end and the lower end are closed by two upper-and-lower-end-side inlet/outlet baffles 83. The inside space of the inlet/outlet header case 81 is partitioned along the vertical direction into an inlet/outlet space 85 in the upper portion and supply spaces 86A to 86L in the lower portion by a boundary-side inlet/outlet baffle 84. The inlet/outlet space 85 is a space communicating with the one ends of the primary heat exchange sections 61A to 61L, and functions as a space that causes the refrigerant that has passed through the refrigerant paths 65A to 65L to merge at the outlets. In this way, the upper portion of the inlet/outlet header 80 having the inlet/outlet space 85 functions as a refrigerant outlet section that causes the refrigerant that has passed through the refrigerant paths 65A to 65L to merge at the outlets. The first gas refrigerant pipe 33 is connected to the inlet/outlet header 80 and communicates with the inlet/outlet space 85. The supply spaces 86A to 86L are plural (here, twelve) spaces partitioned from each other by plural (here, eleven) supply-side inlet/outlet baffles 87 and communicating with the one ends of the secondary heat exchange sections 62A to 62L, and function as spaces that cause the refrigerant to flow out to the refrigerant paths 65A to 65L.

In this way, the lower portion of the inlet/outlet header 80 having the plural supply spaces 86A to 86L functions as a refrigerant supply section 86 that causes the refrigerant to flow out dividedly to the plural refrigerant paths 65A to 65L.

<Refrigerant Distributor>

The refrigerant distributor 70, as described above, is a refrigerant passage part that distributes the refrigerant flowing in through the liquid refrigerant pipe 35 and causes the refrigerant to flow out to the downstream side (here, the plural heat transfer tubes 63); the refrigerant distributor 70 is provided on the one end side of the heat exchange section 60, and the one ends of the heat transfer tubes 63 are connected to the refrigerant distributor 70 via the refrigerant supply section 86 of the inlet/outlet header 80. The refrigerant distributor 70 is a member made of aluminum or aluminum alloy and extending in the vertical direction, and mainly has a distributor case 71 that is vertically long and hollow. The distributor case 71 mainly has a distributor header tubular body 72 having an open cylinder shape whose upper end and lower end are open, and the openings in the upper end and the lower end are closed by two upper-and-lower-end-side distribution baffles 73. Here, the upper-and-lower-end-side distribution baffles 73 are plate members having a circular shape in which a semicircular arc-shaped edge portion 73*a* is formed, and are brazed and joined in a state in which they have been inserted, from the side surface of the distributor case 71, into insertion slits 72*a* formed in the upper end and the lower end of the distributor header tubular body 72.

Inside the distributor case 71, there are formed plural (here, twelve) distribution passages 74A to 74L disposed along the circumferential direction, a distribution space 75 for guiding the refrigerant to the plural distribution passages 74A to 74L, and plural (here, twelve) discharge spaces 76A to 76L that communicate with the distribution space 75 by means of the plural distribution passages 74A to 74L and are disposed along the vertical direction.

The plural (here, twelve) distribution passages 74A to 74L are formed by a rod member 74 disposed inside the distributor case 71. The rod member 74 is a rod-shaped member extending in the vertical direction and in which are formed the plural distribution passages 74A to 74L disposed along the circumferential direction. The rod member 74 is manufactured by extruding aluminum or aluminum alloy, and the plural distribution passages 74A to 74L are configured by plural (here, twelve) holes extending in the longitudinal direction of the rod member 74 and formed integrally with the rod member 74. The radial direction central part of the rod member 74 is surrounded by the plural distribution passages 74A to 74L. The upper end that is the other end in the longitudinal direction of the rod member 74 is in contact with the lower surface of the upper-and-lower-end-side distribution baffle 73 provided in the upper end of the distributor case 71, and so the upper ends of the plural distribution passages 74A to 74L are closed. In contrast, the lower end that is one end in the longitudinal direction of the rod member 74 extends as far as the lower portion of the distributor case 71 but does not reach the upper surface of the upper-and-lower-end-side distribution baffle 73 provided in the lower end of the distributor case 71, and so the lower ends of the plural distribution passages 74A to 74L are not closed. Because of this, a space opposing the lower end of the rod member 74 and including the distribution space 75 is formed inside the distributor case 71.

The outer diameter of the rod member 74 is smaller than the inner diameter of the distributor case 71, a space is formed between the side surface of the rod member 74 and the distributor case 71 in the radial direction, and this space forms the plural discharge spaces 76A to 76L. Here, plural (here, eleven) rod passing baffles 77, in which are formed rod passing holes 77*b* through which the rod member 74 passes, are inserted into the distributor case 71 from the side surface of the distributor case 71, and the plural discharge spaces 76A to 76L are formed by the plural rod passing baffles 77. Here, the rod passing baffles 77 are plate members having a circular shape in which a semicircular arc-shaped edge portion 77*a* is formed, and the rod passing baffles 77 are brazed and joined in a state in which they have been inserted, from the side surface of the distributor case 71, into insertion slits 72*b* formed along the vertical direction in the side surface of the distributor header tubular body 72. Because of this, the rod member 74 is disposed inside the distributor case 71 in a state in which the rod member 74 has been multiply passed along the vertical direction through the rod passing holes 77*b* in the rod passing baffles 77. In this way, the space between the side surface of the rod member 74 and the distributor case 71 in the radial direction is partitioned by the plural rod passing baffles 77 into the plural discharge spaces 76A to 76L along the vertical direction.

Plural (here, twelve) rod side surface holes 74*a* are formed in the side surface of the rod member 74, and the plural discharge spaces 76A to 76L and the plural distribution passages 74A to 74L communicate with each other by means of the plural rod side surface holes 74*a*. Here, the plural distribution passages 74A to 74L and the plural discharge spaces 76A to 76L correspond to each other in a 1:1 ratio. The rod side surface holes 74*a* are formed in such a way that a distribution passage communicating with a given discharge space does not communicate with the other discharge spaces, so, for example, the rod side surface hole 74*a* communicating with the discharge space 76A is formed so as to correspond to just the distribution passage 74A, and the rod side surface hole 74*a* communicating with the discharge space 76B is formed so as to correspond to just the distribution passage 74B. Furthermore, the plural rod side surface holes 74*a* are disposed helically along the longitudinal direction of the rod member 74 (here, the vertical direction).

The distributor case 71 is provided with a nozzle member 79, in which a nozzle hole 79*b* is formed, so as to partition the space opposing the lower end of the rod member 74 into an introduction space 78 for introducing the inflowing refrigerant and the distribution space 75 for guiding the refrigerant to the plural distribution passages 74A to 74L.

The nozzle member 79 is a plate member made of aluminum or aluminum alloy and having a circular shape in which a semicircular arc-shaped edge portion 79*a* is formed. In the nozzle member 79, a nozzle recess portion 79*d* that is a recessed part larger in diameter than the nozzle hole 79*b* is formed in a rod member-side end surface 79*c* that is an end surface on the one end (here, the lower end) side in the longitudinal direction of the rod member 74, and the distribution space 75 is configured by the space surrounded by the lower end of the rod member 74 and the nozzle recess portion 79*d*. Here, the distribution space 75 is formed by bringing the lower end of the rod member 74 into abutting contact with the rod member-side end surface 79*c*. The nozzle recess portion 79*d* is formed in such a way that its diameter increases stepwise heading toward the lower end of the rod member 74. Furthermore, in the lower end of the rod member 74 is formed an inlet portion 74*b* surrounded by the plural distribution passages 74A to 74L and opposing the nozzle hole 79*b*, and the area of the inlet portion 74*b* is larger than the open area of the nozzle hole 79*b*. It should be noted that the introduction space 78 is a space for introducing the refrigerant flowing in through the liquid refrigerant pipe 35 from the lower end side surface of the distributor case 71 on the lower side of the nozzle member 79.

The nozzle member 79, which serves as a plate-shaped holed plate member in which is formed the nozzle hole 79*b* that is a hole through which the refrigerant passes, is inserted into the distributor case 71 from the side surface of the distributor case 71. Here, the nozzle member 79 is fitted together with the distributor case 71, in a state in which it cannot move sideways relative to the distributor case 71, as a result of being inserted into the distributor case 71 via an insertion slit 72*c* formed in the side surface of the distributor case 71 and then being moved in the lengthwise direction of the distributor case 71 (here, the downward direction). Specifically, a step portion 79*e* that projects in the downward direction of the distributor case 71 is formed in a surface (here, the lower surface) of the nozzle member 79 in the lengthwise direction of the distributor case 71. Additionally, the nozzle member 79 is fitted together with the distributor case 71, in a state in which the nozzle member 79 cannot move sideways relative to the distributor case 71, as a result of a side surface 79*f* of the step portion 79*e* coming into contact with the inner surface of the distributor case 71 when the nozzle member 79 is moved in the downward direction of the distributor case 71. Moreover, after the nozzle member 79 has been moved in the downward direction of the distributor case 71 (that is, after the nozzle member 79 has been fitted together with the distributor case 71), a gap is formed in the insertion slit 72*c*, but here the rod passing baffle 77 is inserted into this gap. That is, here, the rod passing baffle 77 is made to function as a gap filling member for filling the gap formed in the insertion slit 72*c* after the nozzle member 79 has been moved in the downward direction of the distributor case 71. The nozzle member 79 and the rod passing baffle 77 are brazed to each other. Because of this, the rod passing baffle 77 that has been inserted into the insertion slit 72*c* becomes disposed on top of the rod member-side end surface 79*c* of the nozzle member 79 in a state in which the lower end of the rod member 74 has been passed through the rod passing hole 77*b*.

In this way, the refrigerant distributor 70 functions as a refrigerant introduction and distribution section extending in the vertical direction and having a refrigerant introduction section 70*a*, in which is formed the introduction space 78 for introducing the inflowing refrigerant from the lower end side surface, and a refrigerant distribution section 70*b*, in which is formed the distribution space 75 for distributing the refrigerant. Additionally, the refrigerant distributor 70 serving as the refrigerant introduction and distribution section is connected to the lower portion of the inlet/outlet header 80 serving as the refrigerant supply section 86 via plural (here, twelve) connecting pipes 88 forming plural (here, twelve) connecting passages 88A to 88L. That is, the plural connecting passages 88A to 88L are parts for guiding the refrigerant from the plural discharge spaces 76A to 76L configuring the refrigerant distribution section 70*b* to the plural supply spaces 86A to 86L in the refrigerant supply section 86. In this way, the lower portion of the inlet/outlet header 80 serving as the refrigerant supply section 86, the refrigerant distributor 70 serving as the refrigerant introduction and distribution section, and the plural connecting pipes 88 forming the plural connecting passages 88A to 88L function as a refrigerant distribution and supply section 89 that causes the inflowing refrigerant to flow out to the plural heat transfer tubes 63 comprising flat tubes on the downstream side.

Additionally, given that the supply space 86A positioned on the lowermost side out of the plural supply spaces 86A to 86L is a lowermost-tier supply space, and that the connecting passage 88A that guides the refrigerant to the lowermost-tier supply space 86A out of the plural connecting passages 88A to 88L is a lowermost-tier connecting passage, and that the heat transfer tube positioned on the lowermost side out of the heat transfer tubes 63 communicating with the lowermost-tier supply space 86A is a first heat transfer tube 63A1 serving as a first flat tube, the first heat transfer tube 63A1 is disposed in a height position H2 included in a height range H1 of the introduction space 78, and the lowermost-tier connecting passage 88A is disposed in a position H3 higher than the introduction space 78. Furthermore, here, given that the heat transfer tube positioned on the uppermost side out of the predetermined number (here, two) of the heat transfer tubes 63 communicating with the lowermost-tier supply space 86A is a second heat transfer tube 63A2 serving as a second flat tube, the lowermost-tier connecting passage 88A is disposed in a height position H3 even with or higher than a height position H4 of the second heat transfer tube 63A2.

(7) Characteristics of Refrigerant Distributor and Outdoor Heat Exchanger

The refrigerant distributor 70 and the outdoor heat exchanger 23 of the present embodiment have the following characteristics.

<A>

In the refrigerant distributor 70 of the present embodiment, as described above, the rod-shaped rod member 74 extending in the vertical direction is disposed inside the distributor case 71, and the plural distribution passages 74A to 74L are configured by plural holes extending in the longitudinal direction of the rod member 74 and formed integrally with the rod member 74.

By disposing the rod member 74 inside the distributor case 71, a structure that can form the plural distribution passages 74A to 74L with a small number of parts can be obtained, and because of this the productivity of the refrigerant distributor 70 can be improved.

Furthermore, in the refrigerant distributor 70 of the present embodiment, as described above, the plural rod side surface holes 74*a* are formed in the side surface of the rod member 74, and the plural discharge spaces 76A to 76L and the plural distribution passages 74A to 74L communicate with each other by means of the plural rod side surface holes 74*a*.

Furthermore, in the refrigerant distributor 70 of the present embodiment, as described above, the plural rod side surface holes 74*a* are disposed helically along the longitudinal direction of the rod member 74.

Furthermore, in the refrigerant distributor 70 of the present embodiment, as described above, the plural rod passing baffles 77, in which are formed the rod passing holes 77*b* through which the rod member 74 passes, are inserted into the distributor case 71 from the side surface of the distributor case 71, and the plural discharge spaces 76A to 76L are formed by the plural rod passing baffles 77.

Furthermore, in the refrigerant distributor 70 of the present embodiment, as described above, the plural distribution passages 74A to 74L and the plural discharge spaces 76A to 76L correspond to each other in a 1:1 ratio.

<B>

In the refrigerant distributor 70 of the present embodiment, as described above, the distributor case 71 is provided with the nozzle member 79, in which the nozzle hole 79*b* is formed, so as to partition the space inside the distributor case 71 opposing the one end in the longitudinal direction of the rod member 74 into the introduction space 78 for introducing the inflowing refrigerant and the distribution space 75 for guiding the refrigerant to the plural distribution passages 74A to 74L. Additionally, the nozzle recess portion 79*d* that is a recessed part larger in diameter than the nozzle hole 79*b* is formed in the rod member-side end surface 79*c* that is the end surface on the one end side in the longitudinal direction of the rod member 74, and the distribution space 75 is configured by the space surrounded by the one end in the longitudinal direction of the rod member 74 and the nozzle recess portion 79*d*.

Here, the nozzle member 79 serving as a distributor member, the introduction space 78, and the distribution space 75 can be formed inside the distributor case 71, and the distribution space 75 can be formed by the space surrounded by the one end in the longitudinal direction of the rod member 74 and the nozzle recess portion 79*d*. Because of this, here, compared to a configuration where the distributor case 71 and the distributor member are provided separately, the size in the vertical direction can be reduced and compactification can be made possible.

Furthermore, in the refrigerant distributor 70 of the present embodiment, as described above, the inlet portion 74*b* surrounded by the plural distribution passages 74A to 74L and opposing the nozzle hole 79*b* is formed in the one end in the longitudinal direction of the rod member 74, and the area of the inlet portion 74*b* is larger than the open area of the nozzle hole 79*b*.

Here, the gas-liquid mixed state of the refrigerant can be uniformly maintained by making it easier to obtain a flow that causes the refrigerant guided through the nozzle hole 79*b* from the introduction space 78 to the distribution space 75 to collide with the inlet portion 74*b*. Because of this, here, it can be made easier to equally guide the refrigerant from the distribution space 75 to the plural distribution passages 74A to 74L.

Furthermore, in the refrigerant distributor 70 of the present embodiment, as described above, the nozzle recess portion 79*d* is formed in such a way that its diameter increases stepwise heading toward the one end in the longitudinal direction of the rod member 74.

Here, compared to a case where the diameter of the nozzle recess portion 79*d* is suddenly increased from the nozzle hole 79*b*, the gas-liquid mixed state of the refrigerant can be uniformly maintained by making it easier to obtain a flow that causes the refrigerant guided through the nozzle hole 79*b* from the introduction space 78 to the distribution space 75 to collide with the inlet portion 74*b*. Because of this, here, it can be made easier to equally guide the refrigerant from the distribution space 75 to the plural distribution passages 74A to 74L.

Furthermore, in the refrigerant distributor 70 of the present embodiment, as described above, the plural discharge spaces 76A to 76L disposed along the vertical direction are formed inside the distributor case 71. Additionally, the plural distribution passages 74A to 74L are formed in the rod member 74 by the plural holes extending in the longitudinal direction of the rod member 74 and formed in the rod member 74. The plural rod side surface holes 74*a* are formed in the side surface of the rod member 74, and the plural discharge spaces 76A to 76L and the plural distribution passages 74A to 74L communicate with each other by means of the plural rod side surface holes 74*a*.

Furthermore, in the refrigerant distributor 70 of the present embodiment, as described above, a rod passing baffle 77, in which is formed the rod passing hole 77*b* through which the rod member 74 passes, is disposed on top of the rod member-side end surface 79*c* of the nozzle member 79.

Here, sideways positional shifting between the rod member 74 and the nozzle member 79 can be prevented, and because of this it can be made easier to equally guide the refrigerant from the distribution space 75 to the plural distribution passages 74A to 74L.

<C>

The refrigerant distributor 70 of the present embodiment, as described above, is a refrigerant passage part configured by inserting, with respect to the distributor case 71 (a case that is vertically long and hollow), the nozzle member 79 (a plate-shaped holed plate member) in which the nozzle hole 79*b* (a hole through which the refrigerant passes) is formed into the distributor case 71 from the side surface of the distributor case 71. Here, the nozzle member 79 is provided so as to partition the space inside the distributor case 71 into the introduction space 78 for introducing the inflowing refrigerant and the distribution space 75 for guiding the refrigerant to the plural distribution passages 74A to 74L. Additionally, the nozzle member 79 is fitted together with the distributor case 71, in a state in which it cannot move sideways relative to the distributor case 71, as a result of being inserted into the distributor case 71 via the insertion slit 72*c* formed in the side surface of the distributor case 71 and then being moved in the lengthwise direction of the distributor case 71.

Here, the nozzle hole 79*b* formed in the nozzle member 79 can be prevented from shifting from its proper position, and because of this, the required flow of refrigerant—that is, the required distribution ability—can be obtained in the refrigerant distributor 70.

Furthermore, in the refrigerant distributor 70 of the present embodiment, as described above, the step portion 79*e* that projects in the lengthwise direction of the distributor case 71 is formed in the surface of the nozzle member 79 in the lengthwise direction of the distributor case 71. Additionally, the nozzle member 79 is fitted together with the distributor case 71, in a state in which it cannot move sideways relative to the distributor case 71, as a result of the side surface 79*f* of the step portion 79*e* coming into contact with the inner surface of the distributor case 71 when the nozzle member 79 is moved in the lengthwise direction of the distributor case 71.

Furthermore, in the refrigerator distributor 70 of the present embodiment, as described above, the rod passing baffle 77, serving as a gap filling member that fills the gap formed after the nozzle member 79 has been moved in the lengthwise direction of the distributor case 71, is inserted into the insertion slit 72*c*.

Furthermore, in the refrigerant distributor 70 of the present embodiment, as described above, the nozzle member 79 and the rod passing baffle 77 serving as the gap filling member are brazed to each other.

<D>

The outdoor heat exchanger 23 serving as the refrigerant evaporator of the present embodiment has, as described above, the plural heat transfer tubes 63 comprising flat tubes disposed along the vertical direction and the refrigerant distribution and supply section 89 that causes the inflowing refrigerant to flow out to the plural heat transfer tubes 63 on the downstream side. Here, the refrigerant distribution and supply section 89 includes the lower portion of the inlet/outlet header 81 serving as the refrigerant supply section 86, the refrigerant distributor 70 serving as the refrigerant introduction and distribution section, and the plural connecting passages 88A to 88L. The refrigerant supply section 86 is a part extending in the vertical direction and in which are formed the plural supply spaces 86A to 86L that divide the plural heat transfer tubes 63 into the plural refrigerant paths 65A to 65L including the predetermined number of the heat transfer tubes 63 along the vertical direction and cause the refrigerant to flow out. The refrigerant introduction and distribution section 70 is a part extending in the vertical direction and having the refrigerant introduction section 70*a*, in which is formed the introduction space 78 for introducing the inflowing refrigerant from the lower end side surface, and the refrigerant distribution section 70*b*, in which is formed the distribution space 75 for distributing the refrigerant. The plural connecting passages 88A to 88L are parts that guide the refrigerant from the refrigerant distribution section 70*b* to the plural supply spaces 86A to 86L in the refrigerant supply section 86. Additionally, given that the supply space 86A positioned on the lowermost side out of the plural supply spaces 86A to 86L is a lowermost-tier supply space, and that the connecting passage 88A that guides the refrigerant to the lowermost-tier supply space 86A out of the plural connecting passages 88A to 88L is a lowermost-tier connecting passage, and that the heat transfer tube 63A1 positioned on the lowermost side out of the heat transfer tubes 63 communicating with the lowermost-tier supply space 86A is a first heat transfer tube serving as a first flat tube, the first heat transfer tube 63A1 is disposed in the height position H2 included in the height range H1 of the introduction space 78, and the lowermost-tier connecting passage 88A is disposed in the position H3 higher than the introduction space 78.

Here, after the refrigerant in a gas-liquid mixed state flowing from the lower end side surface into the refrigerant introduction and distribution section 70 has been distributed equally by the refrigerant introduction and distribution section 70, the refrigerant can be guided through the lowermost-tier connecting passage 88A to the lowermost-tier supply space 86A in the refrigerant supply section 86. Because of this, here, the refrigerant evaporator can be made into one suited for installation on the bottom plate 52 of the casing 51 of the outdoor unit 2 or the like of the air conditioning apparatus 1, while ensuring its ability to distribute the refrigerant to the plural flat tubes 63 including the first flat tube 63A1 in the lowermost-tier supply space 86A.

Furthermore, in the outdoor heat exchanger 23 serving as the refrigerant evaporator of the present embodiment, as described above, the introduction space 78 and the distribution space 75 are partitioned from each other by the nozzle member 79 in which the nozzle hole 79*b* is formed.

Here, the height dimensions of the introduction space 78 and the distribution space 75 can be reduced, and the height position of the lowermost-tier connecting passage 88A can also be lowered.

Furthermore, in the outdoor heat exchanger 23 serving as the refrigerant evaporator of the present embodiment, as described above, the nozzle recess portion 79*d* that is a recessed part larger in diameter than the nozzle hole 79*b* is formed in the upper surface of the nozzle member 79, and the distribution space 75 is configured by the space formed by the nozzle recess portion 79*d*.

Here, the height dimension of the distribution space 75 can be reduced because of the nozzle recess portion 79*d* formed in the nozzle member 79, and the height position of the lowermost-tier connecting passage 88A can also be lowered.

Furthermore, in the outdoor heat exchanger 23 serving as the refrigerant evaporator of the present embodiment, as described above, given that the heat transfer tube 63A2 positioned on the uppermost side out of the predetermined number of the heat transfer tubes 63 communicating with the lowermost-tier supply space 88A is a second heat transfer tube serving as a second flat tube, the lowermost-tier connecting passage 88A is disposed in a height position even with or higher than the second flat tube 63A2 (that is, H3≥H4).

Here, the refrigerant can be kept from becoming easier to be introduced to the second flat tube 63A2 out of the flat tubes communicating with the lowermost-tier supply space 86A in the refrigerant supply section 86, and the refrigerant in the gas-liquid mixed state flowing to the flat tubes 63A1 and 63A2 communicating with the lowermost-tier supply space 86A can be equalized.

(8) Example Modifications

<A>

Figure 19:
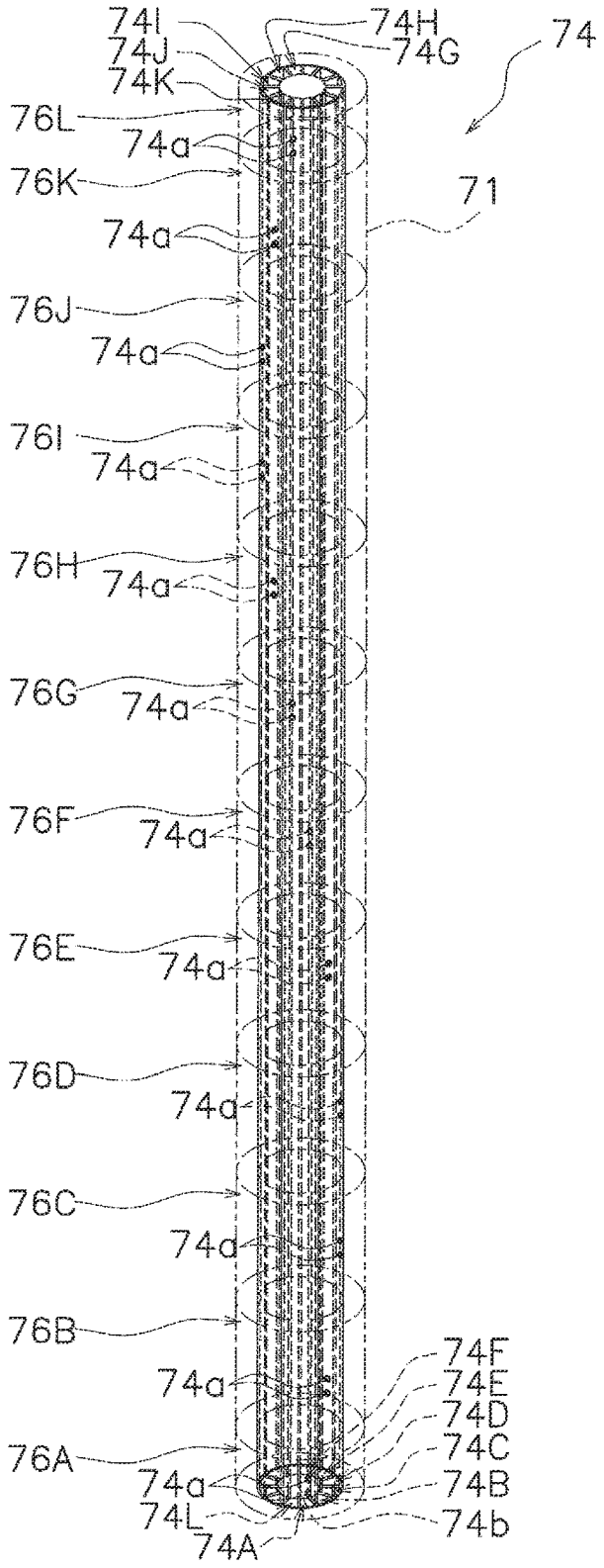
FIG. 19 is a view, corresponding to FIG. 11, showing a refrigerant distributor pertaining to an example modification.

In the refrigerant distributor 70 pertaining to the embodiment, there is one each of the rod passing holes 74*a* that communicate the plural distribution passages 74A to 74L to the plural discharge spaces 76A to 76L, but the refrigerant distributor 70 is not limited to this. For example, as shown in FIG. 19, there may also be a plurality each (here, two each) of the rod passing holes 74*a* that communicate the plural distribution passages 74A to 74L to the plural discharge spaces 76A to 76L.

<B>

Figure 20:
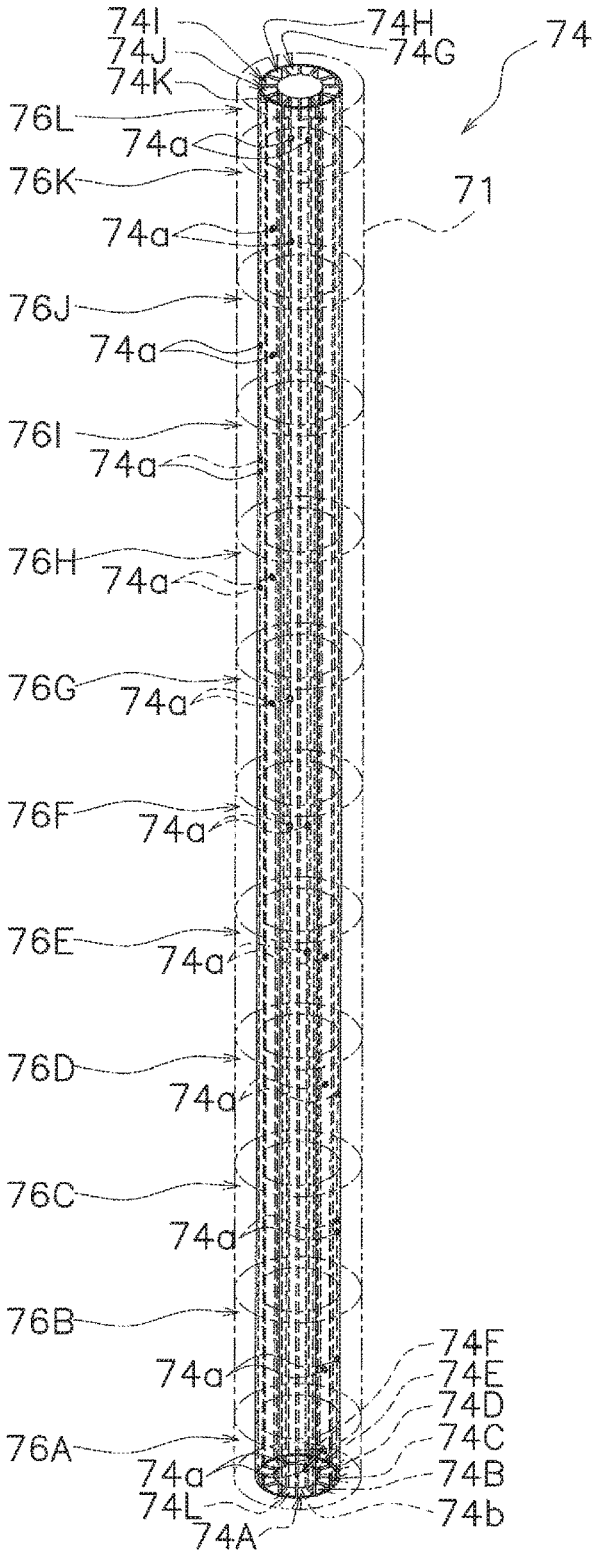
FIG. 20 is a view, corresponding to FIG. 11, showing a refrigerant distributor pertaining to an example modification.

In the refrigerant distributor 70 pertaining to the embodiment, the plural distribution passages 74A to 74L and the plural discharge spaces 76A to 76L correspond to each other in a 1:1 ratio, but the refrigerant distributor 70 is not limited to this. For example, as shown in FIG. 20, the refrigerant distributor 70 may also have a configuration where the plural distribution passages 74A to 74L and the plural discharge spaces 76A to 76L do not correspond to each other in a 1:1 ratio, so, for example, a rod side surface hole 74*a* communicating with plural (here, two) distribution passages is formed with respect to a given single discharge space, or a rod side surface hole 74*a* communicating with plural (here, two) discharge spaces is formed with respect to a given single distribution passage.

<C>

Figure 21:
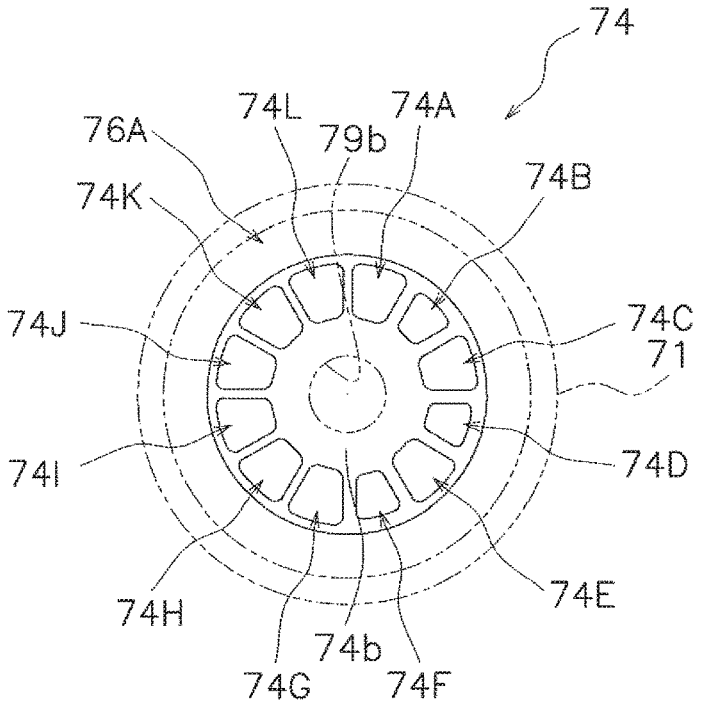
FIG. 21 is a view, corresponding to FIG. 12, showing a refrigerant distributor pertaining to an example modification.

In the refrigerant distributor 70 pertaining to the embodiment, the open sizes of the plural distribution passages 74A to 74L are all made the same and the diameters of the plural rod side surface holes 74*a* are also all made the same, but the refrigerant distributor 70 is not limited to this. For example, as shown in FIG. 21, the open sizes of any of the distribution passages 74A to 74L may also be made different from those of the other distribution passages (here, the open sizes of the distribution passages 74B, 74D, and 74F are made smaller than those of the other distribution passages 74A, 74C, 74E, and 74G to 74L).

<D>

Figure 22:
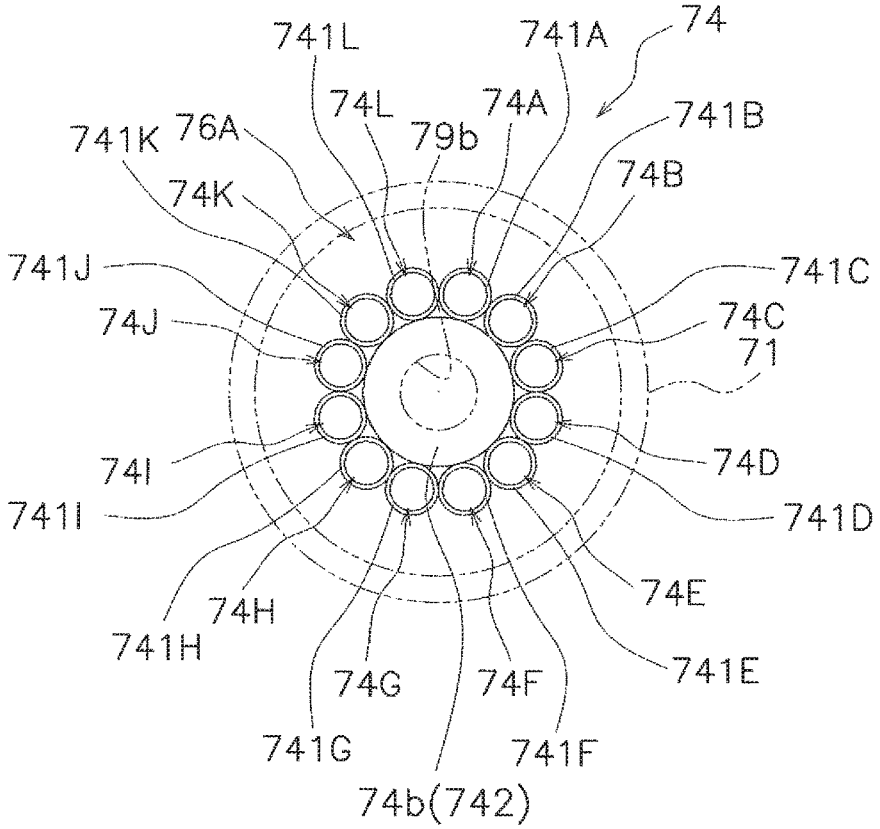
FIG. 22 is a view, corresponding to FIG. 12, showing a refrigerant distributor pertaining to an example modification.
Figure 23:
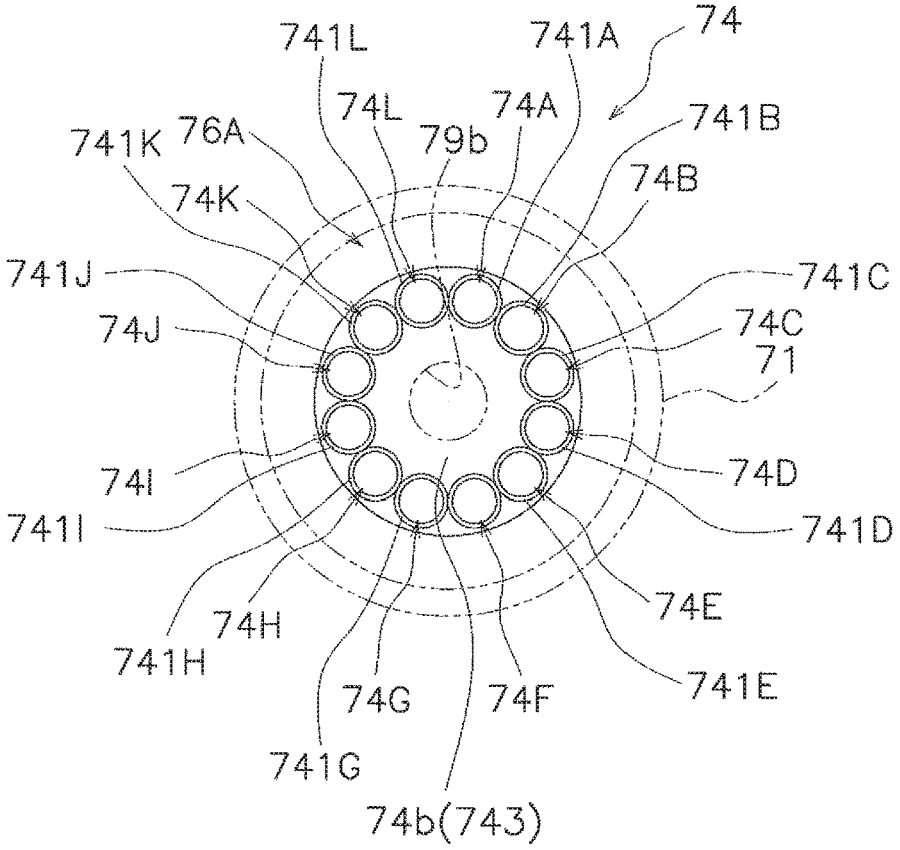
FIG. 23 is a view, corresponding to FIG. 12, showing a refrigerant distributor pertaining to an example modification.

In the refrigerant distributor 70 pertaining to the embodiment, the rod member 74 is a rod-shaped member extending in the vertical direction and in which the plural distribution passages 74A to 74L disposed along the circumferential direction are integrally formed, but the rod member 74 is not limited to this. For example, as shown in FIG. 22 and FIG. 23, the rod member 74 may also be configured by bundling together along the circumferential direction plural (here, twelve) small pipe members 741A to 741L forming the plural distribution passages 74A to 74L. Although it is not shown in the drawings here, the plural rod side surface holes 74*a* are formed in the side surfaces of the plural small pipe members 741A to 741L like in the rod member 74 of the embodiment, and the plural discharge spaces 76A to 76L and the plural distribution passages 74A to 74L communicate with each other by means of the plural rod side surface holes 74*a*. It should be noted that as shown in FIG. 22 a central rod 742 may be provided in the section surrounded by the plural small pipe members 741A to 741L, and the lower end of the central rod 742 may be made to serve as the inlet portion 74*b*. Furthermore, as shown in FIG. 23, rather than the central rod 742, a partition body 743 through which the plural small pipe members 741A to 741L can be passed may be provided on the lower ends of the plural small pipe members 741A to 741L, and the central part of the partition body 743 may be made to serve as the inlet portion 74*b*.

<E>

Figure 24:
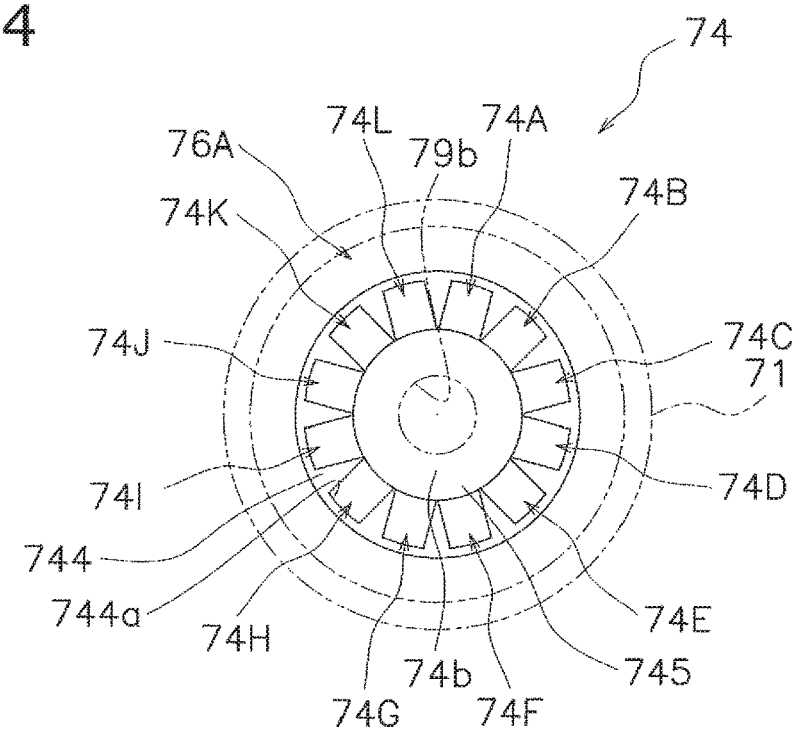
FIG. 24 is a view, corresponding to FIG. 12, showing a refrigerant distributor pertaining to an example modification.
Figure 25:
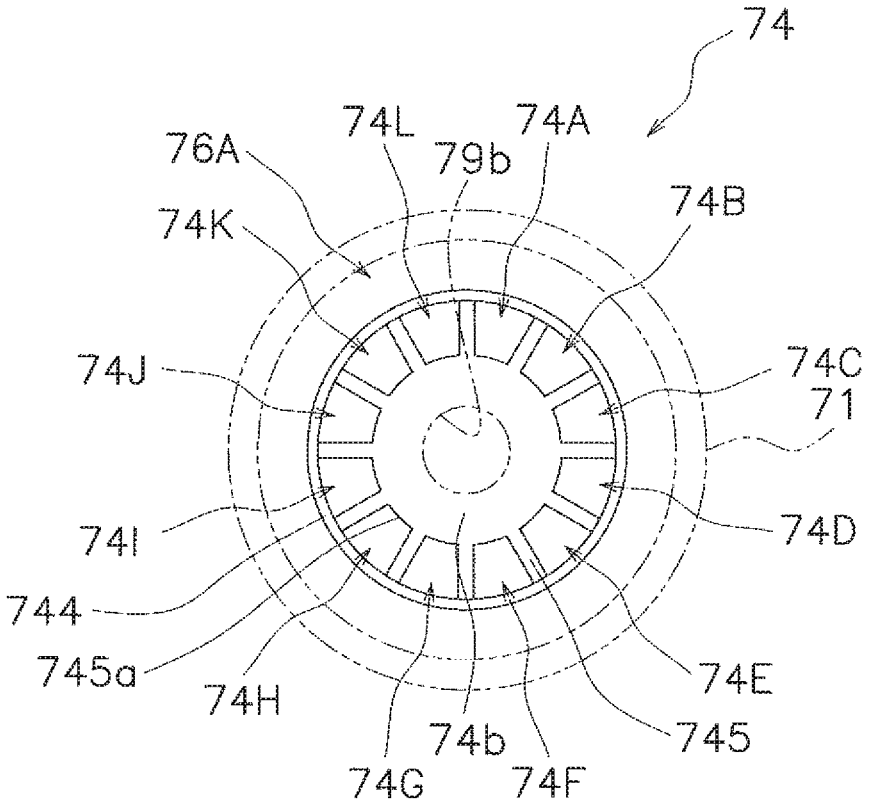
FIG. 25 is a view, corresponding to FIG. 12, showing a refrigerant distributor pertaining to an example modification.

In the refrigerant distributor 70 pertaining to the embodiment, the rod member 74 is a rod-shaped member extending in the vertical direction and in which the plural distribution passages 74A to 74L disposed along the circumferential direction are integrally formed, but the rod member 74 is not limited to this. For example, as shown in FIG. 24 and FIG. 25, the rod member 74 may also be configured by a tubular outer rod member 744 and an inner rod member 745 disposed on the inner peripheral side of the outer rod member 744. Here, plural (here, twelve) grooves 744*a* or 745*a* extending in the longitudinal direction of the rod member 74 may be formed in at least one of the inner peripheral surface of the outer rod member 744 and the outer peripheral surface of the inner rod member 745, so that the plural distribution passages 74A to 74L are formed by the spaces surrounded by the plural grooves 744*a* or 745*a* and the inner peripheral surface of the outer rod member 744 or the outer peripheral surface of the inner rod member 745. Although it is not shown in the drawings here, the plural rod side surface holes 74*a* are formed in the side surface of the outer rod member 744 like in the rod member 74 of the embodiment, and the plural discharge spaces 76A to 76L and the plural distribution passages 74A to 74L communicate with each other by means of the plural rod side surface holes 74*a*. It should be noted that here the central part of the lower end of the inner rod member 745 becomes the inlet portion 74*b*.

<F>

In the outdoor heat exchanger 23 serving as the refrigerant evaporator pertaining to the embodiment, the refrigerant supply section 86 is formed in the inlet/outlet header case 81 extending in the vertical direction, the refrigerant introduction and distribution section (here, the refrigerant distributor 70) is formed in the distributor case 71 extending in the vertical direction, and the inlet/outlet header case 81 and the distributor case 71 are connected to each other via the plural connecting pipes 88 forming the plural connecting passages 88A to 88L, but the outdoor heat exchanger 23 is not limited to this. For example, although it is not shown in the drawings here, the refrigerant supply section 86, the refrigerant introduction and distribution section 70, and the plural connecting passages 88A to 88L may also be formed in a single header-distributor dual purpose case (e.g., the lower portion of the inlet/outlet header case 81) extending in the vertical direction. Furthermore, in the case of forming the refrigerant introduction and distribution section 70 in the lower portion of the inlet/outlet header case 81, the refrigerant supply section 86 and the plural connecting passages 88A to 88L may be omitted to directly communicate the heat transfer tubes 63 to the plural discharge spaces 76A to 76L.

<G>

The refrigerant distributor 70 pertaining to the embodiment is configured in such a way that the rod member 74 is disposed in the upper portion of the inside of the distributor case 71, the nozzle member 79 is disposed in the lower portion of the inside the distributor case 71, and the refrigerant is introduced from the lower end of the distributor case 71, but the refrigerant distributor 70 is not limited to this. For example, although it is not shown in the drawings here, the refrigerant distributor 70 may also be configured in such a way that the rod member 74 is disposed in the lower portion of the inside of the distributor case 71, the nozzle member 79 is disposed in the upper portion of the inside of the distributor case 71, and the refrigerant is introduced from the upper end of the distributor case 71.

<H>

Figure 26:
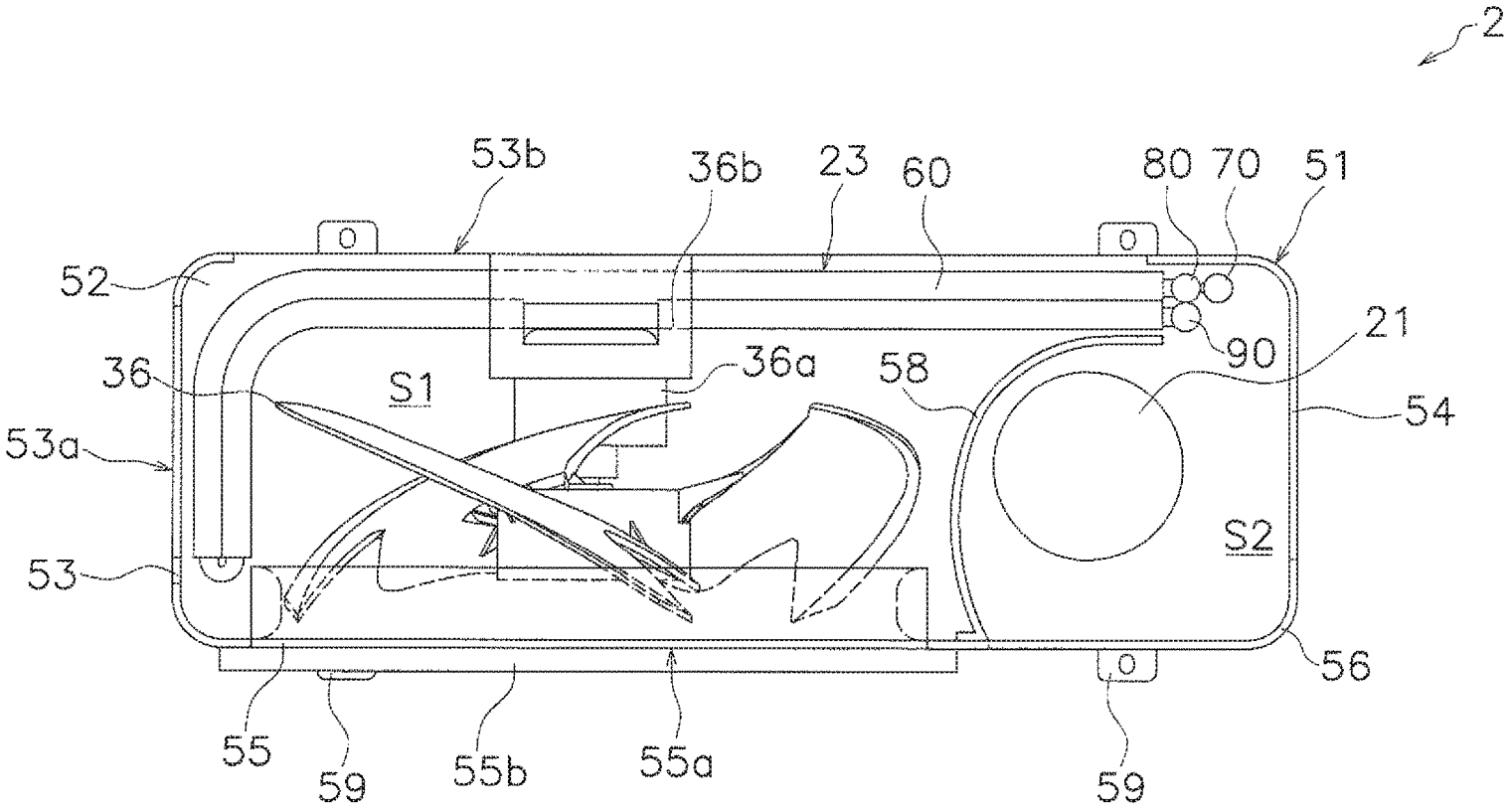
FIG. 26 is a plan view showing a state in which a top plate of an outdoor unit having an outdoor heat exchanger pertaining to an example modification has been removed.

In the outdoor heat exchanger 23 pertaining to the embodiment, a configuration where the heat transfer tubes 63 comprising flat tubes are disposed in plural tiers along the vertical direction in just one row as seen in a plan view is taken as an example and described, but the outdoor heat exchanger 23 is not limited to this. For example, as shown in FIG. 26, the outdoor heat exchanger 23 may also have a configuration where two rows of the heat transfer tubes 63 as seen in a plan view are disposed in plural tiers along the vertical direction. In this case, the other ends (left ends) in the longitudinal direction of the heat transfer tubes 63 turn back around toward the one ends (right ends) in the longitudinal direction, so not just the refrigerant distributor 70 and the inlet/outlet header 80 but also the intermediate header 90 become provided on the one end (right end) side of the heat transfer tubes 63.

<I>

In the refrigerant distributor 70 serving as the refrigerant introduction and distribution section pertaining to the embodiment, as shown in FIG. 10, the distal end portion of the liquid refrigerant pipe 35 is provided in such a way as to project just a little into the inside of the introduction space 78 from the lower end side surface of the distributor case 71, but the refrigerant distributor 70 is not limited to this.

Figure 27:
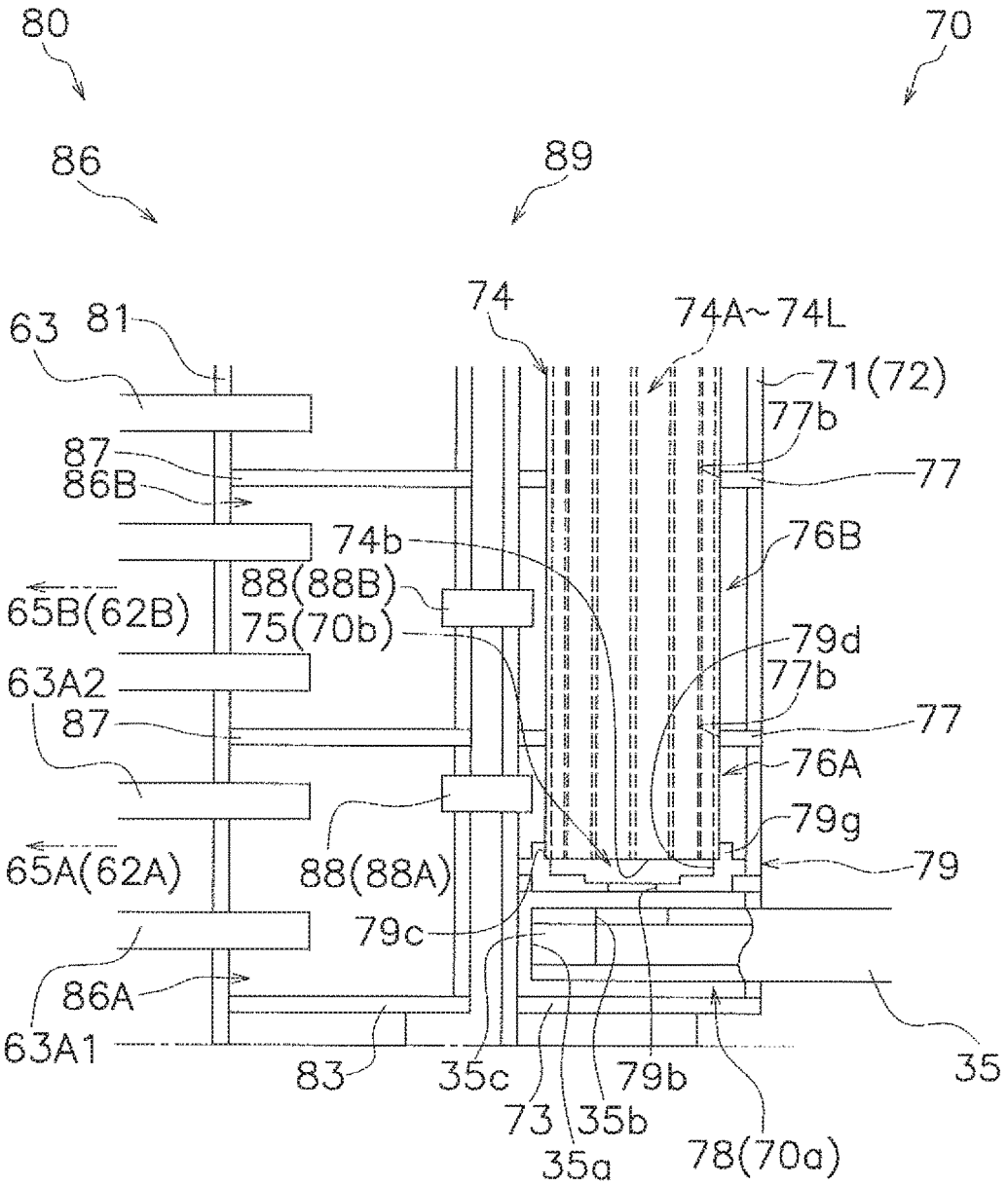
FIG. 27 is a view, corresponding to FIG. 10, showing a refrigerant distributor pertaining to an example modification.
Figure 28:
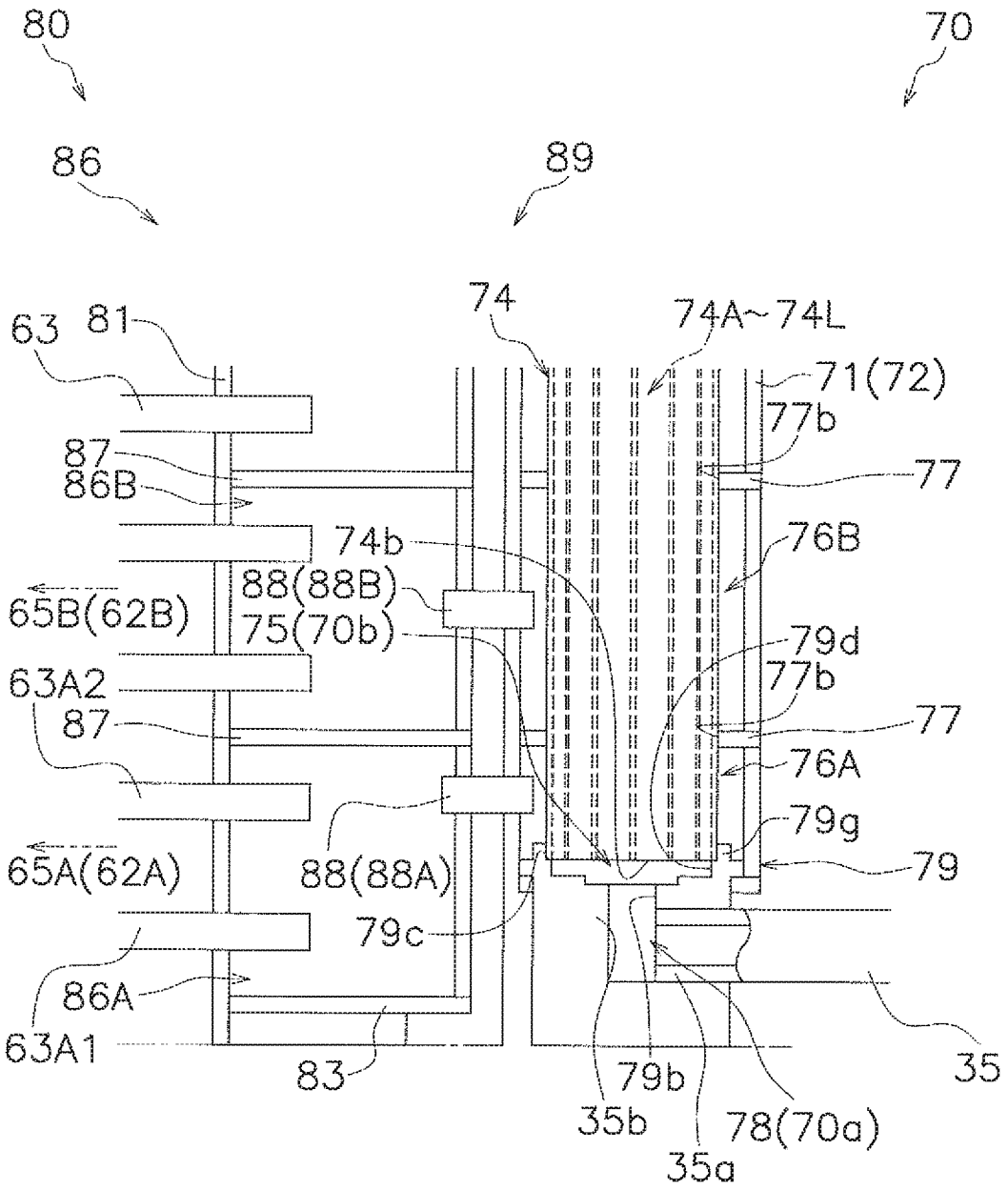
FIG. 28 is a view, corresponding to FIG. 10, showing a refrigerant distributor pertaining to an example modification.

For example, as shown in FIG. 27, the distal end portion of the liquid refrigerant pipe 35 may also be provided in such a way as to project as far as the central portion of the inside of the introduction space 78 from the lower end side surface of the distributor case 71. At this time, a terminal end opening 35*a* in the distal end portion of the liquid refrigerant pipe 35 is closed, and an introduction hole 35*b* is formed in the distal end portion of the liquid refrigerant pipe 35 in a position opposing the nozzle hole 79*b* in the nozzle member 79. In this case, the refrigerant introduced from the liquid refrigerant pipe 35 to the introduction space 78 can be quickly guided from the introduction space 78 to the distribution space 75, accumulation of the liquid refrigerant inside the introduction space 78 when introducing the refrigerant can be reduced, and the occurrence of abnormal sounds can be reduced. Here, the terminal end opening 35*a* in the distal end portion of the liquid refrigerant pipe 35 is closed by a rivet 35*c* reaching as far as a position neighboring the introduction hole 35*b*, so accumulation of the liquid refrigerant inside the distal end portion of the liquid refrigerant pipe 35 can also be reduced. It should be noted that the method of closing the terminal end opening 35*a* is not limited to a method resulting from the rivet 35*c*, and the terminal end opening 35*a* may also be spun closed or pinch closed. Furthermore, as shown in FIG. 28, the nozzle member 79 may be extended downward, the distal end portion of the liquid refrigerant pipe 35 may be directly connected to the nozzle member 79 and communicated to the nozzle hole 79, and the refrigerant may be introduced from the lower end side surface of the nozzle member 79. In this case, the nozzle member 79 substantially forms the introduction space 78, so accumulation of the liquid refrigerant can be further reduced.

<J>

In the refrigerant distributor 70 pertaining to the embodiment, as shown in FIG. 10, the one end in the longitudinal direction of the rod member 74 is in abutting contact with the rod member-side end surface 79*c* of the nozzle member 79, and the one end (here, the lower end) in the longitudinal direction of the rod member 74 is fitted into the rod passing hole 77*b* of the rod passing baffle 77, but the refrigerant distributor 70 is not limited to this.

For example, as shown in FIG. 27 and FIG. 28, a rod fitting portion 79*g* for fitting the one end (here, the lower end) in the longitudinal direction of the rod member 74 may also be formed in the rod member-side end surface 79*c* of the nozzle member 79 to prevent sideways positional shifting between the rod member 74 and the nozzle member 79.

INDUSTRIAL APPLICABILITY

The present invention is widely applicable to refrigerant evaporators equipped with plural flat tubes disposed along the vertical direction and a refrigerant distributor that causes inflowing refrigerant to flow out to the plural flat tubes on the downstream side.

What is claimed is:

1. A refrigerant evaporator comprising:

a plurality of flat tubes disposed along a vertical direction; and a refrigerant distribution and supply section that causes inflowing refrigerant to flow out to the plurality of flat tubes on a downstream side, the refrigerant distribution and supply section including a refrigerant supply section extending in the vertical direction and having a plurality of supply spaces formed therein that divide the plurality of flat tubes into a plurality of refrigerant paths including a predetermined number of the flat tubes along the vertical direction and cause the refrigerant to flow out, a refrigerant introduction and distribution section extending in the vertical direction and having a refrigerant introduction section with an introduction space formed therein to introduce the inflowing refrigerant from a lower end side surface, and a refrigerant distribution section a distribution space formed therein to distribute the refrigerant, and a plurality of connecting passages that guide the refrigerant from the refrigerant distribution section to the plurality of supply spaces in the refrigerant supply section, and a lowermost-tier supply space of the plurality of supply space positioned on a lowermost side relative to a remainder of the plurality of supply spaces, and a lowermost-tier connecting passage of the plurality of connecting passages guiding the refrigerant to the lowermost-tier supply space, and a first flat tube of the plurality of flat tubes being positioned on the lowermost side relative to a remainder of the flat tubes communicating with the lowermost-tier supply space, the first flat tube being disposed at a height position included in a height range of the introduction space, and the lowermost-tier connecting passage being disposed at a position higher than the introduction space.

2. The refrigerant evaporator according to claim 1, wherein the introduction space and the distribution space are partitioned from each other by a nozzle member having a nozzle hole formed therein.

3. The refrigerant evaporator according to claim 2, wherein the nozzle member has a nozzle recess portion formed in an upper surface thereof, the nozzle recess portion is a recessed part larger in diameter than the nozzle hole, and the distribution space is configured by a space formed by the nozzle recess portion.

4. The refrigerant evaporator according to claim 1, wherein a second flat tube of the plurality of the flat tubes is positioned on an uppermost side relative to a remainder of the predetermined number of the flat tubes communicating with the lowermost-tier supply space, the lowermost-tier connecting passage is disposed at a height position even with or higher than the second flat tube.

5. The refrigerant evaporator according to claim 1, wherein the refrigerant supply section, the refrigerant introduction and distribution section, and the connecting passages are formed in a single header-distributor dual purpose case extending in the vertical direction.

6. The refrigerant evaporator according to claim 1, wherein the refrigerant supply section is formed in a header case extending in the vertical direction, the refrigerant introduction and distribution section is formed in a distributor case extending in the vertical direction, and the header case and the distributor case are connected to each other via a plurality of connecting pipes forming the plurality of connecting passages.

7. The refrigerant evaporator according to claim 2, wherein a second flat tube of the plurality of the flat tubes is positioned on an uppermost side relative to a remainder of the predetermined number of the flat tubes communicating with the lowermost-tier supply space, the lowermost-tier connecting passage is disposed at a height position even with or higher than the second flat tube.

8. The refrigerant evaporator according to claim 2, wherein the refrigerant supply section, the refrigerant introduction and distribution section, and the connecting passages are formed in a single header-distributor dual purpose case extending in the vertical direction.

9. The refrigerant evaporator according to claim 2, wherein the refrigerant supply section is formed in a header case extending in the vertical direction, the refrigerant introduction and distribution section is formed in a distributor case extending in the vertical direction, and the header case and the distributor case are connected to each other via a plurality of connecting pipes forming the plurality of connecting passages.

10. The refrigerant evaporator according to claim 3, wherein a second flat tube of the plurality of the flat tubes is positioned on an uppermost side relative to a remainder of the predetermined number of the flat tubes communicating with the lowermost-tier supply space, the lowermost-tier connecting passage is disposed at a height position even with or higher than the second flat tube.

11. The refrigerant evaporator according to claim 3, wherein the refrigerant supply section, the refrigerant introduction and distribution section, and the connecting passages are formed in a single header-distributor dual purpose case extending in the vertical direction.

12. The refrigerant evaporator according to claim 3, wherein the refrigerant supply section is formed in a header case extending in the vertical direction, the refrigerant introduction and distribution section is formed in a distributor case extending in the vertical direction, and the header case and the distributor case are connected to each other via a plurality of connecting pipes forming the plurality of connecting passages.

13. The refrigerant evaporator according to claim 4, wherein the refrigerant supply section, the refrigerant introduction and distribution section, and the connecting passages are formed in a single header-distributor dual purpose case extending in the vertical direction.

14. The refrigerant evaporator according to claim 4, wherein the refrigerant supply section is formed in a header case extending in the vertical direction, the refrigerant introduction and distribution section is formed in a distributor case extending in the vertical direction, and the header case and the distributor case are connected to each other via a plurality of connecting pipes forming the plurality of connecting passages.

* * * * *